US010545421B2

(12) United States Patent
Mizoguchi et al.

(10) Patent No.: US 10,545,421 B2
(45) Date of Patent: Jan. 28, 2020

(54) TONER, TONER STORED UNIT, IMAGE FORMING APPARATUS, AND METHOD FOR PRODUCING TONER

(71) Applicants: Yuka Mizoguchi, Shizuoka (JP); Hiroshi Yamashita, Shizuoka (JP); Ryota Inoue, Shizuoka (JP); Taichi Nemoto, Shizuoka (JP); Shizuka Hashida, Saitama (JP)

(72) Inventors: Yuka Mizoguchi, Shizuoka (JP); Hiroshi Yamashita, Shizuoka (JP); Ryota Inoue, Shizuoka (JP); Taichi Nemoto, Shizuoka (JP); Shizuka Hashida, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/904,551

(22) Filed: Feb. 26, 2018

(65) Prior Publication Data

US 2018/0267417 A1 Sep. 20, 2018

(30) Foreign Application Priority Data

Mar. 16, 2017 (JP) ..... 2017-051406
Nov. 8, 2017 (JP) ..... 2017-215601

(51) Int. Cl.
*G03G 9/087* (2006.01)
*G03G 9/08* (2006.01)

(52) U.S. Cl.
CPC ..... *G03G 9/08755* (2013.01); *G03G 9/0804* (2013.01); *G03G 9/0819* (2013.01);
(Continued)

(58) Field of Classification Search
CPC ..... G03G 9/08755; G03G 9/0825; G03G 9/0804; G03G 9/08786; G03G 9/08764
See application file for complete search history.

(56) References Cited

U.S. PATENT DOCUMENTS 6,890,695 B2 * 5/2005 Shirai ..... G03G 9/081 430/109.4
9,182,694 B2 * 11/2015 Yamada ..... G03G 9/08755
(Continued)

FOREIGN PATENT DOCUMENTS

EP 3106922 B1 * 8/2018
JP 2624639 4/1997
(Continued)

OTHER PUBLICATIONS

English language machine translation of JP 2002-287426 (Oct. 2002).*

(Continued)

*Primary Examiner* — Christopher D Rodee
(74) *Attorney, Agent, or Firm* — Oblon, McClelland, Maier & Neustadt, L.L.P.

(57) ABSTRACT

Provided is a toner including at least: a non-crystalline polyester resin; and a crystalline polyester resin, wherein when a cross-section of the toner is observed, the crystalline polyester resin has a maximum length of 100 nm or greater but less than 500 nm, and a ratio Dv/Dn of a volume average diameter Dv of the crystalline polyester resin to a number average diameter Dn of the crystalline polyester resin is less than 1.20.

9 Claims, 1 Drawing Sheet

(52) U.S. Cl.
CPC ..... *G03G 9/0825* (2013.01); *G03G 9/0827* (2013.01); *G03G 9/08764* (2013.01); *G03G 9/08786* (2013.01)

(56) References Cited

U.S. PATENT DOCUMENTS

| | | | | |
|---|---|---|---|---|
| 9,256,146 | B2 * | 2/2016 | Kawamura | G03G 9/0825 |
| 9,477,166 | B2 * | 10/2016 | Iwazaki | G03G 9/08755 |
| 2011/0076612 | A1 | 3/2011 | Awamura et al. | |
| 2015/0072277 | A1 | 3/2015 | Sugiura et al. | |
| 2015/0072286 | A1 | 3/2015 | Kumai et al. | |
| 2016/0223926 | A1 | 8/2016 | Miyaake et al. | |
| 2016/0259258 | A1 * | 9/2016 | Mine | G03G 9/08797 |
| 2016/0363878 | A1 * | 12/2016 | Hama | G03G 9/08755 |
| 2016/0370720 | A1 | 12/2016 | Yamashita et al. | |
| 2017/0017175 | A1 | 1/2017 | Yamada et al. | |
| 2017/0108791 | A1 | 4/2017 | Hashida et al. | |
| 2017/0329245 | A1 * | 11/2017 | Shibata | G03G 9/0804 |

FOREIGN PATENT DOCUMENTS

| | | | | |
|---|---|---|---|---|
| JP | 2002287426 | A * | 10/2002 | G03G 9/081 |
| JP | 2005-015589 | | 1/2005 | |
| JP | 2005-107387 | | 4/2005 | |
| JP | 3689647 | | 6/2005 | |
| JP | 3762075 | | 1/2006 | |
| JP | 2011-075766 | | 4/2011 | |
| JP | 2012-172074 | | 9/2012 | |
| JP | 2015-052712 | | 3/2015 | |
| JP | 2015-072445 | | 4/2015 | |
| WO | WO-2016093365 | A1 * | 6/2016 | G03G 9/0804 |

OTHER PUBLICATIONS

Diamond, Arthur S. (ed.) Handbook of Imaging Materials. New York:Marcel-Dekker, Inc. (2002) pp. 145-164.*

* cited by examiner

TONER, TONER STORED UNIT, IMAGE FORMING APPARATUS, AND METHOD FOR PRODUCING TONER

CROSS-REFERENCE TO RELATED APPLICATIONS

The present application claims priority under 35 U.S.C. § 119 to Japanese Patent Application No. 2017-051406 filed Mar. 16, 2017, and Japanese Patent Application No. 2017-215601 filed Nov. 8, 2017. The contents of which are incorporated herein by reference in their entirety.

BACKGROUND OF THE INVENTION

Field of the Invention

The present disclosure relates to a toner, a toner stored unit, an image forming apparatus, and a method for producing a toner.

Description of the Related Art

In recent years, there has been a need for toners to have a small particle diameter and hot offset resistance for improvement of output image qualities, to have low-temperature fixability for energy-saving, and to have heat-resistant storage stability sufficient for enduring high temperatures and high humidities during storage and transportation after production. Particularly, improvement of low-temperature fixability matters significantly because power consumption during fixing accounts for large part of power consumption in the image forming process.

Hitherto, toners produced by a kneading/pulverizing method have been used. However, the toners produced by the kneading/pulverizing method have problems: the toners cannot realize sufficient output image qualities because it is difficult to make the toners small in particle diameter and the toners have irregular shapes and broad particle diameter distributions; and the toners need a high fixing energy. When waxes (release agents) are added in the toners to be produced by the kneading/pulverizing method in order to improve fixability, the toners are torn at wax interfaces during pulverization, to have much wax on the toner surfaces. This facilitates the releasing effect, but on the other hand, makes adhesion (filming) of the toners on carriers, photoconductors, and blades more likely to occur. This is problematic because the total performance of the toners cannot be satisfactory.

Hence, in order to overcome the problems of the kneading/pulverizing method, there has been proposed a toner producing method based on a polymerization method. Toners to be produced by the polymerization method can be made small in particle diameter easily, have sharper particle size distributions than the toners produced by the kneading/pulverizing method, and can have releasing agents enclosed inside. As a toner producing method based on the polymerization method and aiming for improvement of low-temperature fixability and improvement of hot offset resistance, there is proposed a method of producing a toner from an elongation reaction product of a urethane-modified polyester serving as a toner binder (see, for example, Japanese Patent No. 3762075 (Patent document 1)).

Further, in order to improve low-temperature fixability, it is known to introduce a crystalline resin having a sharp melting property. That is, with crystallinity, the crystalline resin can maintain heat-resistant storage stability until immediately before the melting start temperature, but at the melting start temperature, the crystalline resin undergoes a sharp viscosity drop (sharp melting property) and fixes.

Therefore, the crystalline resin makes it possible to design a toner having both of a good heat-resistant storage stability and a good low-temperature fixability. Furthermore, in order to improve low-temperature fixability and maintain toner qualities in a high-temperature, high-humidity environment, there are disclosed methods for making a crystalline resin small in particle diameter. There is disclosed a method of dissolving a crystalline resin together with a non-crystalline resin in an organic solvent by heating in order to obtain a stable dispersion liquid of the crystalline resin having a small particle diameter, cooling the obtained solution to recrystallize the crystalline resin, and making the resultant into particles with a mechanical pulverizer (see, for example, Japanese Patent No. 5467505 (Patent document 2)). There are disclosed some more methods for making a crystalline resin small in particle diameter in a dispersion liquid (see, for example, Japanese Patent No. 5779902 (Patent document 3), Japanese Unexamined Patent Application Publication No. 2005-107387 (Patent document 4), and Japanese Unexamined Patent Application Publication No. 2005-015589 (Patent document 5)).

Further, there is disclosed a toner in which a dispersion particle diameter of a crystalline resin is small and the ratio between the longer axis and shorter axis of the crystalline resin is from 2 through 15 (see, for example, Japanese Unexamined Patent Application Publication No. 2015-72445 (Patent document 6)).

Furthermore, there is disclosed a toner in which a ratio (Dv/Dn) of a volume average diameter Dv of a crystalline polyester resin to a number average diameter Dn of the crystalline polyester resin is from 1.0 through 2.25 in order to make the dispersion particle diameter of the crystalline polyester resin uniform (see, for example, Japanese Unexamined Patent Application Publication No. 2015-52712 (Patent document 7)).

SUMMARY OF THE INVENTION

According to one aspect of the present disclosure, a toner includes at least a non-crystalline polyester resin and a crystalline polyester resin. When a cross-section of the toner is observed, the crystalline polyester resin has a maximum length of 100 nm or greater but less than 500 nm, and a ratio Dv/Dn of a volume average diameter Dv of the crystalline polyester resin to a number average diameter Dn of the crystalline polyester resin is less than 1.20.

DESCRIPTION OF THE EMBODIMENTS

Figure 1:
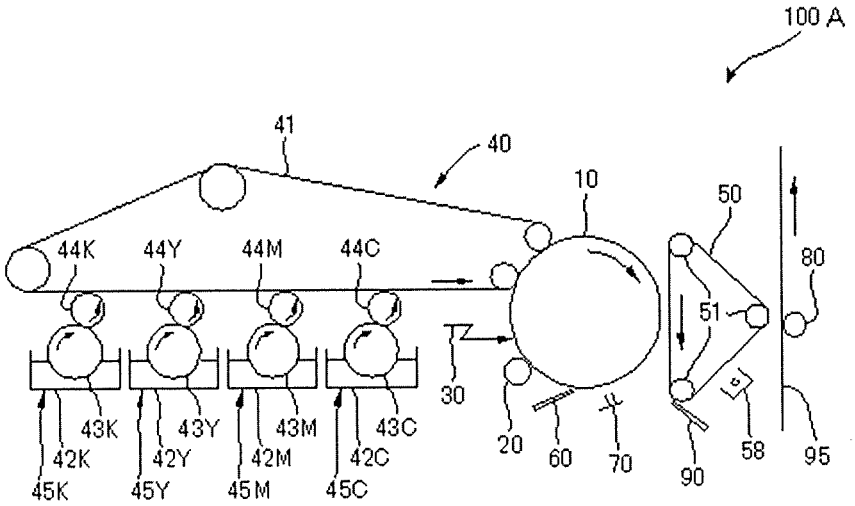
FIG. 1 is a schematic configuration diagram illustrating an example of an image forming apparatus of the present disclosure.

The present disclosure has an object to provide a toner having a better low-temperature fixability and a better heat-resistant storage stability and having an excellent image quality.

The present disclosure can provide a toner having a better low-temperature fixability and a better heat-resistant storage stability and having an excellent image quality.

The methods described in Patent documents 2 to 5 mentioned above have a problem that the crystalline resin, which has a small particle diameter in the dispersion liquid though, undergoes coalescing of the crystalline resin particles in the toner production process, leading to crystal growth and a large particle diameter.

As regards the toner described in Patent document 6 mentioned above, merely making the dispersion particle diameter small is insufficient for achieving a better low-temperature fixability, because this cannot ensure a uniform softening property inside the toner. Further, because the crystalline resin has a flat shape, the coverage of the toner surface with the crystalline resin will be high if a longer-axis side of the crystalline resin is exposed on the toner surface. This makes the toner aggregate or become unsmooth. This leads to problems of a poor flowability, a poor output image quality, and a poor heat-resistant storage stability due to a higher occurrence likelihood of a blocking phenomenon in which the toner is solidified by, for example, heat generated by a machine and heat during storage.

In Patent document 7 mentioned above, the toner is produced by mechanically dispersing the crystalline polyester resin. This method is insufficient for suppressing unevenness (Dv/Dn) in the dispersion particle diameter of the crystalline polyester resin. This method also has a problem that the crystalline polyester resin reaggregates in the toner production process, as in Patent document 2. Furthermore, Patent document 4 does describe the value of the volume average diameter Dv of the crystalline polyester resin, but does not describe the shape (for example, an aspect ratio (longer axis/shorter axis)). Therefore, when the crystalline polyester resin has a large aspect ratio (longer axis/shorter axis), the crystalline polyester resin may exceed the maximum length defined in the present disclosure. In this case, there is a problem that the crystalline polyester resin adversely affects the heat-resistant storage stability, if the crystalline polyester resin is exposed on the toner surface.

Hence, the present inventors have conducted earnest studies, and have found it possible to obtain a toner that contains a non-crystalline polyester resin and a crystalline polyester resin and in which, when a cross-section of the toner is observed, the crystalline polyester resin has a maximum length of 100 nm or greater but less than 500 nm and a ratio Dv/Dn of a volume average diameter Dv of the crystalline polyester resin to a number average diameter Dn of the crystalline polyester resin is less than 1.20. The present inventors have found that such a toner is the toner aimed for as an object of the present disclosure, i.e., a toner having a better low-temperature fixability and a better heat-resistant storage stability and a high image quality.

In the present disclosure, a toner is produced not by obtaining a crystalline polyester dispersion liquid (a dispersion liquid in a solvent) through mechanical dispersion of a crystalline polyester resin, but by producing an emulsion dispersion liquid (a dispersion liquid in water) of a crystalline polyester resin through phase-transfer emulsification. Production of an emulsion through phase-transfer emulsification makes it possible to produce a dispersion liquid of a crystalline polyester resin in water having a good Dv/Dn. A toner is produced by a new method of mixing this dispersion liquid in water with an oil phase (solvent) during toner emulsification. When there is rather a large difference between SP (solubility parameter) values ($cal^{1/2}/cm^{3/2}$) of a non-crystalline polyester resin and a crystalline polyester resin, which are main resins, the crystalline polyester resin does not undergo crystal growth during toner emulsification, making it possible to obtain a toner in which the crystalline polyester resin maintains the particle diameter (from 100 nm through 500 nm) which the crystalline polyester resin has in the emulsion.

This new method seems to work favorably in obtaining a desired value for the Dv/Dn value and a desired value for the maximum length.

The method for producing a toner of the present disclosure will be described below in detail.

(Toner)

A toner of the present disclosure contains at least a non-crystalline polyester resin and a crystalline polyester resin as binder resins. So long as the requirements described above are satisfied, the toner may contain other binder resins than the non-crystalline polyester resin and the crystalline polyester resin. The toner further contains other components such as a colorant and a release agent as needed.

<Crystalline Polyester Resin>

The crystalline polyester resin is obtained from a polyvalent alcohol and a polyvalent carboxylic acid or a derivative of a polyvalent carboxylic acid such as a polyvalent carboxylic acid, a polyvalent carboxylic anhydride, and a polyvalent carboxylic acid ester.

In the present disclosure, a crystalline polyester resin refers to a product obtained with the use of a polyvalent alcohol and a polyvalent carboxylic acid or a derivative of a polyvalent carboxylic acid such as a polyvalent carboxylic acid, a polyvalent carboxylic anhydride, and a polyvalent carboxylic acid ester as described above. Products obtained by modifying polyester resins (e.g., prepolymers), and resins obtained by allowing the prepolymers to undergo a cross-linking reaction or an elongation reaction or both of a cross-linking reaction and an elongation reaction do not belong to the crystalline polyester resin.

<<Polyvalent Alcohol>>

The polyvalent alcohol is not particularly limited and may be appropriately selected depending on the intended purpose. Examples of the polyvalent alcohol include diols and trivalent or higher alcohols.

Examples of the diols include saturated aliphatic diols. Examples of the saturated aliphatic diols include straight-chain saturated aliphatic diols and branched saturated aliphatic diols. Among these diols, straight-chain saturated aliphatic diols are preferable, and straight-chain saturated aliphatic diols containing from 2 through 12 carbon atoms are more preferable. Branched saturated aliphatic diols may degrade crystallinity of the crystalline polyester resin and lower the melting point of the crystalline polyester resin. Practical materials for saturated aliphatic diols containing more than 12 carbon atoms are hardly available.

Examples of the saturated aliphatic olio's include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these saturated aliphatic olio's, ethylene glycol, 1,4-butanediol, 1,6-hexanediol, 1,8-octanediol, 1,9-nonanediol, 1,10-decanediol, and 1,12-dodecanediol are preferable because these saturated aliphatic diols can provide the crystalline polyester resin with a high crystallinity and an excellent sharp melting property.

Examples of the trivalent or higher alcohols include glycerin, trimethylolethane, trimethylolpropane, and pentaerythritol.

One of these polyvalent alcohols may be used alone or two or more of these polyvalent alcohols may be used in combination.

<<Polyvalent Carboxylic Acid>>

The polyvalent carboxylic acid is not particularly limited and may be appropriately selected depending on the intended purpose. Examples of the polyvalent carboxylic acid include divalent carboxylic acids and trivalent or higher carboxylic acids.

Examples of the divalent carboxylic acids include: saturated aliphatic dicarboxylic acids such as oxalic acid, succinic acid, glutaric acid, adipic acid, suberic acid, azelaic acid, sebaccic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids such as phthalic acid, isophthalic acid, terephthalic acid, naphthalene-2,6-dicarboxylic acid, malonic acid, and mesaconic acid. Further examples of the divalent carboxylic acids include anhydrides of these divalent carboxylic acids and lower (containing from 1 through 3 carbon atoms) alkyl esters of these divalent carboxylic acids.

Examples of the trivalent or higher carboxylic acids include 1,2,4-benzenetricarboxylic acid, 1,2,5-benzenetricarboxylic acid, and 1,2,4-naphthalene tricarboxylic acid, and anhydrides of these trivalent or higher carboxylic acids and lower (containing from 1 through 3 carbon atoms) alkyl esters of these trivalent or higher carboxylic acids.

One of these polyvalent carboxylic acids may be used alone or two or more of these polyvalent carboxylic acids may be used in combination.

It is preferable that the crystalline polyester resin be formed of a straight-chain saturated aliphatic dicarboxylic acid containing from 4 through 12 carbon atoms and a straight-chain saturated aliphatic diol containing from 2 through 12 carbon atoms. This can provide a high crystallinity and an excellent sharp melting property, leading to an excellent low-temperature fixability.

Examples of a method for controlling crystallinity and a softening point of the crystalline polyester resin include a method of, during synthesis of the polyester, designing or using a nonlinear polyester that is obtained by performing condensation polymerization with addition of a trivalent or higher polyvalent alcohol such as glycerin to the alcohol component and a trivalent or higher polyvalent carboxylic acid such as trimellitic anhydride to the acid component.

The molecular structure of the crystalline polyester resin of the present disclosure can be confirmed by, for example, an NMR measurement with a solution or a solid, X-ray diffractometry, GC/MS, LC/MS, or an IR measurement. A simple example is a molecular structure that has absorption based on δCH (out-of-plane deformation vibration) of olefin at 965±10 $cm^{-1}$ or 990±10 $cm^{-1}$ in an infrared ray absorption spectrum.

The molecular weight of the crystalline polyester resin was earnestly studied from the viewpoint that a sharp molecular weight distribution and a low molecular weight provide an excellent low-temperature fixability but a high amount of a low-molecular-weight component provides a poor heat-resistant storage stability. According to the result, it is preferable that an o-dichlorobenzene-soluble component of the crystalline polyester resin have a peak position in a range of from 3.5 through 4.0 and a peak half-value width of 1.5 or less in a diagram of a GPC molecular weight distribution representing log (M) on the horizontal axis and weight % on the vertical axis, and have a weight average molecular weight (Mw) of from 3,000 through 30,000 and a number average molecular weight (Mn) of from 1,000 through 10,000 with Mw/Mn being from 1 through 10. It is more preferable that the weight average molecular weight (Mw) be from 5,000 through 15,000, that the number average molecular weight (Mn) be from 2,000 through 10,000, and that Mw/Mn be from 1 through 5.

It is preferable that the acid value of the crystalline polyester resin be 5 mgKOH/g or greater in order to achieve the intended low-temperature fixability from the viewpoint of affinity between paper and the resin, more preferably 10 mgKOH/g or greater for production of particles by a phase-transfer emulsification method, and on the other hand, 45 mgKOH/g or less in order to improve a hot offset property. It is preferable that the hydroxyl value of the crystalline polymer be from 0 mgKOH/g through 50 mgKOH/g and more preferably from 5 mgKOH/g through 50 mgKOH/g in order to achieve a predetermined low-temperature fixability and achieve a good charging property.

<Binder Resin>

The toner of the present disclosure can contain any other binder resin component than the crystalline polyester resin described above. The any other binder resin component than the crystalline polyester resin is not particularly limited, and examples of the any other binder resin component include known binder resins such as non-crystalline polyester resins, silicone resins, styrene/acrylic resins, styrene resins, acrylic resins, epoxy resins, diene-based resins, phenol resins, terpene resins, coumarin resins, amide-imide resins, butyral resins, urethane resins, and ethylene/vinyl acetate resin.

Among these binder resin components, the toner contains at least a non-crystalline polyester resin, which has a sufficient flexibility even with a low molecular weight, because the non-crystalline polyester resin can sharply melt during fixing and make the image surface smooth. Any other resin may further be used in combination with the non-crystalline polyester resin.

<Non-Crystalline Polyester Resin>

Examples of the non-crystalline polyester resin include a polyester resin containing a urethane bond or a urea bond or both of a urethane bond and a urea bond (prepolymer), and an unmodified polyester resin free of a urethane bond or a urea bond or both of a urethane bond and a urea bond.

As the non-crystalline polyester resin, it is preferable to include a polyester resin containing a urethane bond and a urea bond. With the polyester resin containing a urethane bond and a urea bond, heat-resistant storage stability by cross-linking can be supplemented, and the margin of low-temperature fixability designing is increased.

<<Unmodified Polyester Resin>>

An unmodified polyester resin refers to a polyester resin that is obtained with the use of a polyvalent alcohol and a polyvalent carboxylic acid or a derivative of a polyvalent carboxylic acid such as a polyvalent carboxylic acid, a polyvalent carboxylic anhydride, and a polyvalent carboxylic acid ester, and that is not modified with, for example, an isocyanate compound.

Examples of the polyvalent alcohol include diols.

Examples of the diols include: bisphenol A-alkylene (containing from 2 through 3 carbon atoms) oxide adducts (with an average of from 1 through 10 moles added), such as polyoxypropylene (2.2)-2,2-bis(4-hydroxyphenyl)propane and polyoxyethylene (2.2)-2,2-bis(4-hydroxyphenyl) propane; ethylene glycol and propylene glycol; and hydrogenated bisphenol A and hydrogenated bisphenol A-alkylene (containing from 2 through 3 carbon atoms) oxide adducts (with an average of from 1 through 10 moles added).

One of these diols may be used alone or two or more of these diols may be used in combination.

Examples of the polyvalent carboxylic acid include dicarboxylic acids.

Examples of the dicarboxylic acids include adipic acid, phthalic acid, isophthalic acid, terephthalic acid, fumaric acid, maleic acid, and succinic acid substituted with an alkyl group containing from 1 through 20 carbon atoms or with an alkenyl group containing from 2 through 20 carbon atoms, such as dodecenylsuccinic acid and octylsuccinic acid. Particularly, it is preferable to include terephthalic acid in an amount of 50 mol % or greater in terms of heat-resistant storage stability.

One of these dicarboxylic acids may be used alone or two or more of these dicarboxylic acids may be used in combination.

For adjustment of acid value and hydroxyl value, the unmodified polyester resin may contain a trivalent or higher carboxylic acid or a trivalent or higher alcohol or both of a trivalent or higher carboxylic acid and a trivalent or higher alcohol at an end of a resin chain.

Examples of the trivalent or higher carboxylic acid include trimellitic acid, pyromellitic acid, or anhydrides of these acids.

Examples of the trivalent or higher alcohol include glycerin, pentaerythritol, and trimethylolpropane.

The molecular weight of the unmodified polyester resin is not particularly limited and may be appropriately selected depending on the intended purpose. However, an extremely low molecular weight may provide the toner with a poor heat-resistant storage stability and a poor resistance against stress from, for example, stirring in a developing device. An extremely high molecular weight may make the viscoelasticity of the toner during melting high and provide the toner with a poor low-temperature fixability. An extremely high amount of a component having a molecular weight of 600 or less may provide the toner with a poor heat-resistant storage stability and a poor resistance against stress from, for example, stirring in a developing device. An extremely low amount of a component having a molecular weight of 600 or less may provide a poor low-temperature fixability. Accordingly, it is preferable that the unmodified polyester resin have a weight average molecular weight (Mw) of from 3,000 through 10,000 and a number average molecular weight (Mn) of from 1,000 through 4,000 in a GPC (gel permeation chromatography) measurement. It is preferable that Mw/Mn be from 1.0 through 4.0.

It is preferable that a component having a molecular weight of 600 or less account for from 2% by mass through 10% by mass of a THF-soluble component. It is possible to extract the unmodified polyester resin with methanol and refine the unmodified polyester resin by removing the component having a molecular weight of 600 or less.

The weight average molecular weight (Mw) of the unmodified polyester resin is more preferably from 4,000 through 7,000. The number average molecular weight (Mn) of the unmodified polyester resin is more preferably from 1,500 through 3,000. Mw/Mn is more preferably from 1.0 through 3.5.

The acid value of the unmodified polyester resin is not particularly limited, may be appropriately selected depending on the intended purpose, and is preferably from 1 mgKOH/g through 50 mgKOH/g and more preferably from 5 mgKOH/g through 30 mgKOH/g.

When the acid value of the unmodified polyester resin is 1 mgKOH/g or higher, the toner tends to have a negatively chargeable property, and a better affinity with paper when fixed on the paper, leading to an improved low-temperature fixability. On the other hand, when the acid value of the unmodified polyester resin is 50 mgKOH/g or lower, it is possible to effectively prevent the problem of the toner being degraded in charging stability, particularly charging stability with respect to environmental fluctuation.

The hydroxyl value of the unmodified polyester resin is not particularly limited, may be appropriately selected depending on the intended purpose, and is preferably 5 mgKOH/g or higher.

Tg of the unmodified polyester resin is preferably from 40 degrees C. through 80 degrees C. and more preferably from 50 degrees C. through 70 degrees C. When Tg of the unmodified polyester resin is 40 degrees C. or higher, it is possible to effectively prevent the problems of a poor heat-resistant storage stability of the toner, a poor resistance of the toner against stress from, for example, stirring in a developing device, and degradation of filming resistance of the toner. On the other hand, when Tg of the unmodified polyester resin is 80 degrees C. or lower, it is possible to effectively prevent the problems of failure of the toner to sufficiently deform upon application of heat and pressure during fixing and a consequent insufficient low-temperature fixability.

<<Polyester Resin Containing Urethane Bond or Urea Bond or Both of Urethane Bond and Urea Bond (Prepolymer)>>

A specific example of a prepolymer used in the present disclosure will be described below. As described below, the polyester resin containing a urethane bond or a urea bond or a both of a urethane bond and a urea bond (prepolymer) is not particularly limited and may be appropriately selected depending on the intended purpose.

It is possible to use a polyester resin containing a diol component and a cross-linkable component and preferably further containing a dicarboxylic acid component as constituent components. Examples of aliphatic diols containing from 3 through 10 carbon atoms include 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol.

It is preferable that the olio' component of the polyester resin contain an odd number of carbon atoms in the main chain moiety and an alkyl group in a side chain. Likewise, a preferable structure of the aliphatic diol containing from 3 through 10 carbon atoms is a structure represented by general formula (1) below.

$$HO—(CR^1R^2)_n—OH \qquad \text{General formula (1)}$$

In the formula above, $R^1$ and $R^2$ each independently represent a hydrogen atom or an alkyl group containing from 1 through 3 carbon atoms and n represents an odd number of from 3 through 9. In the n repeating units, $R^1$ and $R^2$ each may be the same or different.

As described above, the cross-linkable component of the polyester resin contains a trivalent or higher aliphatic alcohol, which is preferably a trivalent or tetravalent aliphatic alcohol in terms of glossiness and image density of a fixed image. The cross-linkable component may only contain a trivalent or higher aliphatic alcohol. Examples of the trivalent or higher aliphatic alcohol include glycerin, trimethylolethane, trimethylolpropane, pentaerythritol, sorbitol, and dipentaerythritol.

The polyester resin contains a urethane bond or a urea bond or both of a urethane bond and a urea bond in order to improve adhesiveness with a recording medium such as paper. Hence, the urethane bond or the urea bond behaves like a pseudo cross-linking point. This makes the rubbery property of the polyester resin stronger and provides the toner with a better heat-resistant storage stability.

Here, for example, diol components and dicarboxylic acid components used in the polyester resin containing a urethane bond or a urea bond or both of a urethane bond and a urea bond (prepolymer) and the polyester resin free of a urethane bond or a urea bond or both of a urethane bond and a urea bond will be described.

—Diol Component—

The diol component is not particularly limited and may be appropriately selected depending on the intended purpose. Examples of the diol component include: aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; diols containing an oxyalkylene group, such as diethylene glycol, triethylene glycol, dipropylene glycol, polyethylene glycol, polypropylene glycol, and polytetramethylene glycol; alicyclic diols such as 1,4-cyclohexanedimethanol, and hydrogenated bisphenol A; adducts of alicyclic diols with alkylene oxide such as ethylene oxide, propylene oxide, and butylene oxide; bisphenols such as bisphenol A, bisphenol F, and bisphenol S; and bisphenol-alkylene oxide adducts such as adducts of bisphenols with alkylene oxide such as ethylene oxide, propylene oxide, and butylene oxide. Among these diol components, aliphatic diols containing from 4 through 12 carbon atoms are preferable.

One of these diols may be used alone or two or more of these diols may be used in combination.

—Dicarboxylic Acid Component—

The dicarboxylic acid component is not particularly limited and may be appropriately selected depending on the intended purpose. Examples of the dicarboxylic acid component include aliphatic dicarboxylic acids and aromatic dicarboxylic acids. Anhydrides, lower (containing from 1 through 3 carbon atoms) alkyl esters, and halides of these dicarboxylic acid components may also be used.

Examples of the aliphatic dicarboxylic acids include succinic acid, adipic acid, sebaccic acid, dodecanedioic acid, maleic acid, and fumaric acid. Examples of the aromatic dicarboxylic acids include phthalic acid, isophthalic acid, terephthalic acid, and naphthalene dicarboxylic acid. Among these dicarboxylic acids, aliphatic dicarboxylic acids containing from 4 through 12 carbon atoms are preferable.

One of these dicarboxylic acids may be used alone or two or more of these dicarboxylic acids may be used in combination.

—Trivalent or Higher Aliphatic Alcohol—

The trivalent or higher aliphatic alcohol is not particularly limited and may be appropriately selected depending on the intended purpose. Examples of the trivalent or higher aliphatic alcohol include glycerin, trimethylolethane, trimethylolpropane, pentaerythritol, sorbitol, and dipentaerythritol.

Among these trivalent or higher aliphatic alcohols, trivalent or tetravalent aliphatic alcohols are preferable. One of these trivalent or higher aliphatic alcohols may be used alone or two or more of these trivalent or higher aliphatic alcohols may be used in combination.

—Polyester Resin Containing Urethane Bond or Urea Bond or Both of Urethane Bond and Urea Bond—

The polyester resin containing a urethane bond or a urea bond or both of a urethane bond and a urea bond is not particularly limited and may be appropriately selected depending on the intended purpose. Examples of the polyester resin containing a urethane bond or a urea bond or both of a urethane bond and a urea bond include a reaction product between a polyester resin containing an active hydrogen group and a polyisocyanate. It is preferable to use this reaction product as a reaction precursor (prepolymer) that is to be reacted with a curing agent described below.

Examples of the polyester resin containing an active hydrogen group include a polyester resin containing a hydroxyl group.

—Polyisocyanate—

The polyisocyanate is not particularly limited and may be appropriately selected depending on the intended purpose. Examples of the polyisocyanate include diisocyanates and trivalent or higher isocyanates.

Examples of the diisocyanates include aliphatic diisocyanates, alicyclic diisocyanates, aromatic diisocyanates, aromatic aliphatic diisocyanates, and isocyanurates, and products obtained by blocking these diisocyanates with, for example, a phenol derivative, oxime, and caprolactam.

Examples of the aliphatic diisocyanates include tetramethylene diisocyanate, hexamethylene diisocyanate, methyl 2,6-diisocyanato caproate, octamethylene diisocyanate, decamethylene diisocyanate, dodecamethylene diisocyanate, tetradecamethylene diisocyanate, trimethylhexane diisocyanate, and tetramethylhexane diisocyanate.

Examples of the alicyclic diisocyanates include isophorone diisocyanate and cyclohexylmethane diisocyanate.

Examples of the aromatic diisocyanates include tolylene diisocyanate, diisocyanato diphenylmethane, 1,5-naphthylene diisocyanate, 4,4'-diisocyanato diphenyl, 4,4'-diisocyanato-3,3'-dimethyldiphenyl, 4,4'-diisocyanato-3-methyldiphenylmethane, and 4,4'-diisocyanato-diphenyl ether.

Examples of the aromatic aliphatic diisocyanates include $\alpha,\alpha,\alpha',\alpha'$-tetramethyl xylylene diisocyanate.

Examples of the isocyanurates include tris(isocyanatoalkyl)isocyanurate and tris(isocyanatocycloalkyl)isocyanurate.

One of these polyisocyanates may be used alone or two or more of these polyisocyanates may be used in combination.

—Curing Agent—

The curing agent is not particularly limited and may be appropriately selected depending on the intended purpose so long as the curing agent is reactive with the prepolymer. Examples of the curing agent include an active hydrogen group-containing compound.

—Active Hydrogen Group-Containing Compound—

The active hydrogen group of the active hydrogen group-containing compound is not particularly limited and may be appropriately selected depending on the intended purpose. Examples of the active hydrogen group include a hydroxyl group (an alcoholic hydroxyl group and a phenolic hydroxyl group), an amino group, a carboxyl group, and a mercapto group. One of these active hydrogen groups may be used alone or two or more of these active hydrogen groups may be used in combination.

As the active hydrogen group-containing compound, amines are preferable because amines can form a urea bond.

Examples of the amines include diamines, trivalent or higher amines, amino alcohols, amino mercaptans, amino acids, and products obtained by blocking these amino groups. One of these amines may be used alone or two or more of these amines may be used in combination.

Among these amines, diamines or mixtures of diamines with small amounts of trivalent or higher amines are preferable.

Examples of the diamines include aromatic diamines, alicyclic diamines, and aliphatic diamines. Examples of the aromatic diamines include phenylenediamine, diethyltoluenediamine, and 4,4'-diaminodiphenylmethane. Examples of the alicyclic diamines include 4,4'-diamino-3,3'-dimethyldicyclohexylmethane, diaminocyclohexane, and isophoronediamine. Examples of the aliphatic diamines include ethylene diamine, tetramethylenediamine, and hexamethylenediamine.

Examples of the trivalent or higher amines include diethylenetriamine and triethylenetetramine.

Examples of the amino alcohols include ethanol amine and hydroxyethyl aniline.

Examples of the amino mercaptans include aminoethyl mercaptan and aminopropyl mercaptan.

Examples of the amino acids include aminopropionic acid and aminocaproic acid.

Examples of the products obtained by blocking the amino groups include ketimine compounds and oxazoline compounds obtained by blocking the amino groups with ketones such as acetone, methyl ethyl ketone, and methyl isobutyl ketone.

The molecular structure of, for example, the non-crystalline polyester resin can be confirmed by, for example, an NMR measurement with a solution or a solid, X-ray diffractometry, GC/MS, LC/MS, or an IR measurement. A simple method is to detect as the non-crystalline polyester resin, a molecular structure that has no absorption based on δCH (out-of-plane deformation vibration) of olefin at 965±10 $cm^{-1}$ and 990±10 $cm^{-1}$ in an infrared ray absorption spectrum.

<Relationship Between Crystalline Polyester Resin and Non-Crystalline Polyester Resin>

A content ratio X (=A/C) of the content (A) of the non-crystalline polyester resin to the content (C) of the crystalline polyester resin in the toner is preferably from 95/5 through 70/30 and more preferably from 95/5 through 85/15.

When the content ratio X (=A/C) is from 95/5 through 70/30, both of low-temperature fixability and heat-resistant storage stability can be satisfied. When the content ratio X of the crystalline polyester resin is 95/5 or higher, low-temperature fixability can be maintained favorably. When the content ratio X of the crystalline polyester resin is 70/30 or lower, the crystalline polyester resin can be prevented from being present on the outermost surface of the toner in an extremely large amount. This makes it possible to effectively prevent the problems of: contamination of a photoconductor and other members leading to a poor image quality; a poor flowability of a developer; and a poor image density. This also makes it possible to effectively prevent the problems of a poor surface property of the toner leading to contamination of a carrier, incapability of long-term sustainability of a sufficient charging property, and impaired environmental stability.

<Methods for Calculating and Analyzing Contents of Toner Constituent Components>

Any method may be used to calculate the contents of the non-crystalline polyester resin and the crystalline polyester resin. Each component may be separated from the toner by, for example, gel permeation chromatography (GPC), and each separated component may be analyzed by a method described below. This makes it possible to calculate the content ratio between the constituent components.

Separation of each component by GPC can be performed by, for example, a method described below.

In a GPC measurement using THF (tetrahydrofuran) as a mobile phase, the eluent is fractionated with, for example, a fraction collector, and fractions corresponding to desired molecular-weight ranges in the total surface integral of the elution curve are gathered.

The gathered eluent is concentrated with, for example, an evaporator and dried. Then, the solid component is dissolved in a deuterated solvent such as deuterated chloroform or deuterated THF and subjected to a $^{1}$H-NMR measurement. From the integrated ratios of the respective elements, the ratio between the constituent monomers of the resin in the eluted component is calculated.

In another method, the eluent is concentrated and then hydrolyzed with, for example, sodium hydroxide. The decomposition product is subjected to qualitative/quantitative analysis by, for example, high-performance liquid chromatography (HPLC). In this way, the ratio between the constituent monomers is calculated.

<<Units Configured to Separate Toner Constituent Components>>

An example of a unit configured to separate each component for analysis of the toner will be described in detail.

First, the toner (1 g) is fed into THF (100 mL) and stirred at 25 degrees C. for 30 minutes, to obtain a solution in which soluble components are dissolved.

The solution is filtrated through a membrane filter having a mesh size of 0.2 micrometers, to obtain the THF-soluble component of the toner.

Next, the THF-soluble component is dissolved in THF to prepare a GPC measurement sample, which is poured into the GPC used for the molecular weight measurement of the resins described above.

Meanwhile, a fraction collector is disposed at the eluent discharging outlet of the GPC, to fractionate the eluent at every predetermined counts. The eluent is obtained for every 5 area % from the start of elution on the elution curve (the start is the rise of the curve).

Next, a 30 mg sample of each eluted fraction is dissolved in deuterated chloroform (1 mL), to which tetramethylsilane (TMS) (0.05% by volume) is added as a standard substance.

The obtained solution is filled into an NMR measurement glass tube having a diameter of 5 mm and subjected to 128 times of integration at a temperature of from 23 degrees C. through 25 degrees C. with a nuclear magnetic resonance apparatus (JNM-AL400 available from JEOL Ltd.), to obtain a spectrum.

The monomer composition such as the non-crystalline polyester resin and the crystalline polyester resin contained in the toner and the composition ratio can be obtained from the peak integrated ratio of the obtained spectrum.

It is preferable to adjust the SP (solubility parameter) values ($cal^{1/2}/cm^{3/2}$) of the crystalline polyester resin and the non-crystalline polyester resin.

When the difference (ΔSP) between the SP values of the crystalline polyester resin and the non-crystalline polyester resin is extremely small, the crystalline polyester resin becomes plasticized and compatibilized with the non-crystalline resin, resulting in crystal growth. This makes it impossible to keep spherical shapes. On the other hand, when ΔSP is extremely large, the crystalline polyester resin does not become plasticized and may not be able to exhibit low-temperature fixability.

ΔSP is preferably from 1.40 $cal^{1/2}/cm^{3/2}$ through 1.65 $cal^{1/2}/cm^{3/2}$.

<Toner Properties>

<<Maximum Length of Crystalline Polyester Resin>>

The maximum length of the crystalline polyester resin in the toner is 100 nm or greater but less than 500 nm.

When the maximum length of the crystalline polyester resin is 100 nm or greater but less than 500 nm, the crystalline polyester resin can efficiently plasticize the surrounding non-crystalline resin (i.e., can make the resin low-temperature meltable). When the maximum length of the crystalline polyester resin is less than 100 nm, the dispersed state of the crystalline polyester resin is extremely minute, to make some part of the crystalline polyester resin plasticize even in a non-heated state, leading to a poor flowability of the whole toner powder, and adverse effects on image quality. On the other hand, when the maximum length of the crystalline polyester resin is 500 nm or greater, progress of plasticization is poorly efficient due to the relation with the contact area between the crystalline polyester resin and the non-crystalline polyester resin. This may not allow sufficient exhibition of the function of the crystalline polyester resin contained and is not favorable in terms of low-temperature fixability.

The maximum length of the crystalline polyester resin is more preferably 210 nm or greater but 500 nm or less.

The maximum length of the crystalline polyester resin in the toner is calculated in the manner described below.

A cross-section of an ultra-thin slice of the toner is observed with a transmission electron microscope (TEM), and the maximum length of the crystalline polyester resin is measured based on the observed image.

Figure 2:
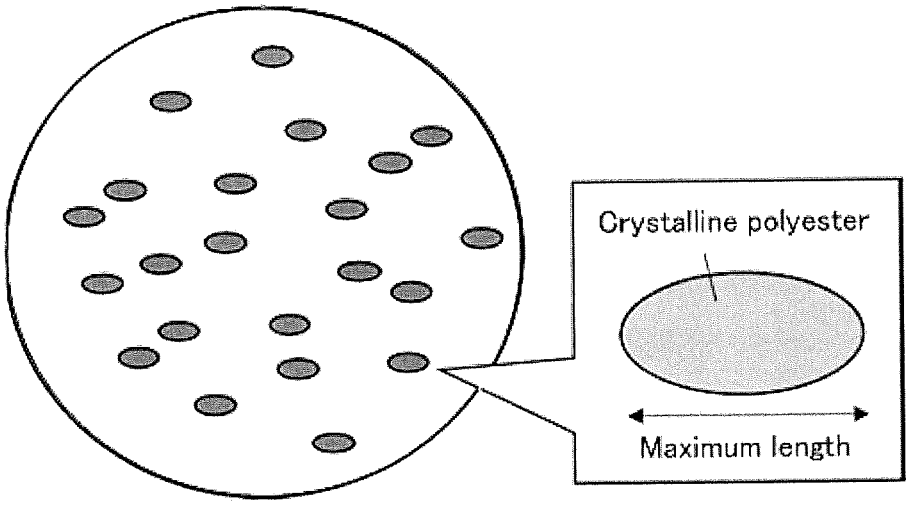
FIG. 2 is an image diagram of a crystalline polyester resin observed when a cross-section of a toner is observed with a transmission electron microscope (TEM).

FIG. 2 illustrates an image of the crystalline polyester resin observed in the toner image. In FIG. 2, the length of the longer axis represents the maximum length.

[Observation and Measurement by TEM]

The produced toner is embedded in an epoxy-based resin and cured. With an ultramicrotome (ULTRACUT UCT available from Leica, using a diamond knife), an ultra-thin slice (with a thickness of around 100 nm) of the toner is produced.

The sample is exposed to a gas of ruthenium tetroxide, osmium tetroxide, or any other stain, for distinguishable staining of the crystalline polyester resin phase and the other portions. The exposition time is appropriately adjusted depending on the contrast during observation. The crystalline polyester resin phase is often observed as a lamellar structure. Subsequently, the sample is observed with a transmission electron microscope (JEM-2100 available from JEOL Ltd.) at an accelerating voltage of 100 kV. Depending on the composition of the crystalline polyester resin and the non-crystalline polyester resin, there is a case when these resins can be distinguished from each other without staining. In that case, evaluation is performed without staining. It is also possible to provide a compositional contrast by any other method such as selective etching. After such a pretreatment, the sample may be observed with a transmission electron microscope, to evaluate the crystalline polyester resin portion.

The observed cross-section image is subjected to, for example, binarization with commercially available image processing software (for example, IMAGE-PRO PLUS), to calculate the maximum length of the crystalline polyester resin portion.

Thirty toner cross-sections are observed, and the maximum length of the crystalline polyester resin portion is calculated in each. The average of the values is calculated and used as the maximum length of the crystalline polyester resin defined in the present disclosure.

Toner cross-sections to be observed are those toner cross-sections that have a longer diameter that is within the range of ±20% of the number average particle diameter of the toner. The number average particle diameter of the toner is measured with MULTISIZER III.

<<Dv/Dn of Crystalline Polyester Resin>>

The ratio Dv/Dn of the volume average diameter Dv of the crystalline polyester resin to the number average diameter Dn of the crystalline polyester resin in the toner is less than 1.20.

When Dv/Dn of the crystalline polyester resin is less than 1.20, the particle size distribution of the crystalline polyester resin within each toner particle is uniform. This allows uniform sharp low-temperature melting within each toner particle and in the whole toner powder during heating. This makes it possible to also satisfy heat-resistant storage stability at the same time. When Dv/Dn is greater than 1.20, the particle size distribution of the crystalline polyester resin within each toner particle is poor. This allows smooth plasticization in the portions in which the crystalline polyester resin has a small particle diameter, but makes plasticization slow in the portions in which the crystalline polyester resin has a large particle diameter. Therefore, the melting property is uneven within each toner particle and in the whole toner powder. This makes it impossible to keep a sharp melting property.

Dv/Dn of the crystalline polyester resin is more preferably 1.15 or less.

Dv/Dn of the crystalline polyester resin in the toner is obtained in the manner described below.

By the same method as described in the description of the maximum length, Dv and Dn of the crystalline polyester resin are measured based on a transmission electron microscopic (TEM) image of a cross-section of an ultra-thin slice of the toner.

The cross-section image is binarized in the same manner as described above, to calculate an equivalent circle diameter of the crystalline polyester resin. According to the formulae below, the volume average diameter Dv and the number average diameter Dn of the crystalline polyester resin are calculated based on the equivalent circle diameter, to obtain Dv/Dn.

$$Dv=\Sigma(n_i \cdot D_i^4)/\Sigma(n_i \cdot D_i^3)$$

$$Dn=\Sigma(n_i \cdot D_i)/\Sigma n_i$$

Here, $n_i$ represents the number of equivalent circle diameters $D_i$ of the crystalline polyester resin. Dv represents an average diameter weighted by a volume. For calculation of Dv/Dn of the crystalline polyester resin, 30 toner cross-sections are observed. Toner cross-sections to be observed are those toner cross-sections that have a longer diameter that is within the range of ±20% of the number average particle diameter of the toner. The number average particle diameter of the toner is measured with MULTISIZER III.

It is more preferable that the crystalline polyester resin satisfy the requirement described below.

<<Shape Factor SF1 of Crystalline Polyester Resin>>

The shape factor SF1 of the crystalline polyester resin is preferably 100 or greater but less than 130.

The shape factor SF1 is 100 when the shape is a true sphere. The greater than 100 the shape factor SF1, the more irregular the shape is. The shape factor SF1 is an indicator of the shape (for example, ellipse and circle) of the crystalline polyester resin.

When the shape factor SF1 is 100 or greater but less than 130, the shape of the crystalline polyester resin is close to a sphere. Therefore, even if the crystalline polyester resin is present near the surface of the toner, the area of contact between the crystalline polyester resin and the surface of the toner will be small. Furthermore, there is an effect of preventing crystalline polyester resin portions from, for example, aggregation with each other. Moreover, it is also possible to prevent toner aggregation due to plasticized portions (compatibilized portions) of the crystalline polyester resin present on the surface.

The shape factor SF1 of from 100 through 120 is more preferable because the crystalline polyester resin is closer to a true sphere.

When the SF1 is 130 or greater, the crystalline polyester resin has a high aspect ratio to have a flat shape. With a flat shape, the crystalline polyester resin, if present on the toner surface, will coat the toner surface with a greater percentage, to cause, for example, aggregation of the crystalline polyester resin portions. This is not preferable because this may lead to, for example, a poor heat-resistant storage stability. Moreover, even in a non-heated state, the crystalline polyester resin portions may aggregate to degrade flowability, leading to a poor image quality.

By the same method as described in the description of the maximum length, the shape factor SF1 of the crystalline polyester resin is measured based on a transmission electron microscopic (TEM) image of a cross-section of an ultra-thin slice of the toner.

The shape factor SF1 is a value obtained from calculation according to the formula below. A preferable value as SF1 is a value obtained with the image processing software mentioned above. However, so long as a similar analysis result can be obtained, the value is not limited to one that is obtained with the transmission electron microscope, the image analyzing device, and the software mentioned above.

$$SF1=(L^2/A)\times(\pi/4)\times 100$$

Here, L represents the maximum length of the crystalline polyester resin, and A represents a projected area of the crystalline polyester resin. The projected area can be calculated by binarization with the image software, like the calculation of Dv/Dn described above.

Other properties of the toner of the present disclosure than the properties described above and the methods for measuring these properties will be described below.

<<Measurement of Particle Diameter of Crystalline Polyester Resin in Crystalline Polyester Resin Dispersion Liquid>>

The particle diameter of the crystalline polyester resin dispersion liquid of the present disclosure can be measured with, for example, a nanotrac particle size distribution measuring instrument UPA-EX150 (available from Nikkiso Co., Ltd., dynamic light scattering method/laser Doppler method). In a specific measuring method, the dispersion liquid in which the resin particles are dispersed is measured after adjustment to a measurable concentration range. Here, the background is measured beforehand using only the dispersion medium of the dispersion liquid. This measuring method allows measurement of from some tens of nanometers through some micrometers, which is the volume average particle diameter range of the resin particles used in the present disclosure.

The particle diameter of the crystalline polyester resin defined in the present disclosure refers to volume average particle diameter (volume average diameter).

In the present disclosure, the particle diameter of the crystalline polyester resin in the crystalline polyester resin dispersion liquid is preferably from 100 nm through 500 nm and more preferably from 210 nm through 500 nm.

<<Method for Measuring Melting Point and Glass Transition Temperature (Tg)>>

In the present disclosure, a melting point and Tg can be measured with, for example, a DSC system (differential scanning calorimeter) ("Q-200", available from TA Instruments).

Specifically, the melting point and the glass transition temperature of a target sample can be measured according to the procedure described below.

First, the target sample (about 5.0 mg) is poured into a sample container formed of aluminum, and the sample container is put on a holder unit and set in an electric furnace. Then, in a nitrogen atmosphere, the sample is heated at a temperature raising rate of 10 degrees C./min from −80 degrees C. to 150 degrees C. (first temperature raise). Subsequently, the sample is cooled at a temperature dropping rate of 10 degrees C./min from 150 degrees C. to −80 degrees C., and then further heated at a temperature raising rate of 10 degrees C./min to 150 degrees C. (second temperature raise). At each of the first temperature raise and the second temperature raise, a DSC curve is measured with the differential scanning calorimeter ("Q-200", available from TA Instruments).

With an analyzing program attached to the Q-200 system, it is possible to obtain the glass transition temperature of the target sample in the first temperature raise by selecting the DSC curve of the first temperature raise from the obtained DSC curves. Likewise, it is possible to obtain the glass transition temperature of the target sample in the second temperature raise, by selecting the DSC curve of the second temperature raise.

Further, with the analyzing program attached to the Q-200 system, it is possible to obtain an endothermic peak top temperature of the target sample in the first temperature raise as the melting point, by selecting the DSC curve of the first temperature raise from the obtained DSC curves. Likewise, it is possible to obtain an endothermic peak top temperature of the target sample in the second temperature raise as the melting point, by selecting the DSC curve of the second temperature raise.

In the present disclosure, as for the melting point and Tg of a constituent component, the endothermic peak top temperature and Tg in the first temperature raise are used as the melting point and Tg of the target sample, unless otherwise specified.

<<Molecular Weight>>

The molecular weights of, for example, the polyester resin and a vinyl-based copolymer resin to be used are measured by GPC (gel permeation chromatography) under the conditions described below, unless otherwise specified.

Apparatus: HLC-8220GPC (available from Tosoh Corporation)

Columns: TSKGEL SUPER HZM-M×3

Temperature: 40 degrees C.

Solvent: THF (tetrahydrofuran)

Flow rate: 0.35 mL/min

Sample: a sample with a concentration of from 0.05% through 0.6% (0.01 mL) is injected A weight average molecular weight Mw of the toner resin is calculated from a molecular weight distribution measured under the conditions described above, using a molecular weight calibration curve generated with monodisperse polystyrene standard samples.

As the monodisperse polystyrene standard samples, 10 samples, namely, 5.8×100, 1.085×10000, 5.95×10000, 3.2×100000, 2.56×1000000, 2.93×1000, 2.85×10000, 1.48×100000, 8.417×100000, and 7.5×1000000 are used.

<<Volume Average Particle Diameter (Dv) and Number Average Particle Diameter (Dn) of Toner>>

The volume average particle diameter (Dv) and the number average particle diameter (Dn) of the toner are measured with a particle size measuring instrument ("MULTISIZER III", available from Beckman Coulter Inc.) at an aperture diameter of 100 micrometers, and analyzed with analyzing software (BECKMAN COULTER MULTISIZER 3 VERSION 3.51). Specifically, a 10% by mass surfactant (alkyl benzene sulfonate NEOGEN SC-A, available from DKS Co., Ltd.) (0.5 mL) is added into a 100 mL beaker made of glass, each toner (0.5 g) is added into the beaker and mixed with a micro spatula, and then ion-exchanged water (80 mL) is added into the beaker. The obtained dispersion liquid is subjected to dispersion treatment for 10 minutes using an ultrasonic disperser (W-113MK-II, available from Honda Electronics Co., Ltd.). The dispersion liquid is measured with MULTISIZER III using ISOTON III (available from Beckman Coulter Inc.) as a solution for measurement. For the measurement, the toner sample dispersion liquid is dropped such that the concentration indicated by the instrument will be 8±2%. For this measuring method, it is convenient to set the concentration to 8±2% from the viewpoint of measurement repeatability of the particle diameter.

<Other Components>

The toner of the present disclosure may contain other components such as a colorant, a release agent, resin particles, a charge controlling agent, inorganic particles, a flow improver, a cleanability improver, a magnetic material, and a metal soap.

<<Colorant>>

The colorant is not particularly limited and may be appropriately selected from known dyes and pigments depending on the intended purpose. Examples of the colorant include carbon black, a nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinone yellow, red iron oxide, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. One of these colorants may be used alone or two or more of these colorants may be used in combination.

The content of the colorant in the toner is not particularly limited, may be appropriately selected depending on the intended purpose, and is preferably from 1% by mass through 15% by mass and more preferably from 3% by mass through 10% by mass. When the content of the colorant is 1% by mass or greater, degradation of the tinting strength of the toner can be prevented. When the content of the colorant is 15% by mass or less, degradation of the tinting strength and degradation of electric properties of the toner due to dispersion failure of the colorant in the toner can be effectively prevented.

The colorant may be used in the form of a masterbatch in which the colorant is combined with a resin. The resin is not particularly limited and may be appropriately selected from known resins depending on the intended purpose. Examples of the resin include polyester, polymers of styrene or styrene substitutes, styrene-based copolymers, polymethyl methacrylate, polybutyl methacrylate, polyvinyl chloride, polyvinyl acetate, polyethylene, polypropylene, epoxy resins, epoxy polyol resins, polyurethane, polyamide, polyvinyl butyral, polyacrylic acid resins, rosin, modified rosin, terpene resins, aliphatic hydrocarbon resins, alicyclic hydrocarbon resins, aromatic petroleum resins, chlorinated paraffin, and paraffin waxes. One of these resins may be used alone or two or more of these resins may be used in combination.

Examples of the polymers of styrene or styrene substitutes include polyester resins, polystyrene, poly p-chlorostyrene, and polyvinyl toluene. Examples of the styrene-based copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-methyl vinyl ketone copolymers, styrene-butadiene copolymers, styrene-isoprene copolymers, styrene-acrylonitrile-indene copolymers, styrene-maleic acid copolymers, and styrene-maleic acid ester copolymers.

The masterbatch can be produced by mixing or kneading the resin for the masterbatch with the colorant under a high shear force. Here, it is preferable to add an organic solvent in order to increase interaction between the colorant and the resin. Furthermore, a so-called flushing method is preferable because this method can use a wet cake of the colorant as is without the need for drying the wet cake. The flushing method is a method of mixing or kneading a water-containing aqueous paste of the colorant with the resin and an organic solvent to transfer the colorant to the resin, and removing the water component and the organic solvent component. For the mixing or kneading, for example, a high-shear disperser such as a three-roll mill is preferable for use. It is well known that a colorant degrades the charging properties of the toner when the colorant is present on the toner surface. Therefore, an increased miscibility of the colorant with the resin obtained in the form of a masterbatch can provide the toner with improved charging properties (for example, environmental stability, charge retainability, and a charge amount).

<<Release Agent>>

The release agent is not particularly limited and may be appropriately selected depending on the intended purpose. A low-melting-point release agent having a melting point of from 50 degrees C. through 120 degrees C. is preferable. By being dispersed with the resins, the low-melting-point release agent effectively functions as a release agent at the interface between a fixing roller and the toner. This provides a good hot offset property in an oilless system (i.e., without application of a release agent such as an oil on the fixing roller).

Preferable examples of the release agent include brazing materials and waxes. Examples of the brazing materials and waxes include natural waxes such as: plant waxes such as carnauba wax, cotton wax, Japan wax, and rice wax; animal waxes such as beeswax and lanolin; mineral waxes such as ozokerite and ceresin; petroleum waxes such as paraffin, microcrystalline, and petrolatum. Other examples than these natural waxes include: synthetic hydrocarbon waxes such as Fischer-Tropsch wax and polyethylene wax; and synthetic waxes such as ester, ketone, and ether. Other usable examples include: fatty acid amides such as 12-hydroxystearic acid amide, stearic acid amide, phthalic anhydride imide, and chlorinated hydrocarbon; and homopolymers of polyacrylates such as poly-n-stearyl methacrylate and poly-n-lauryl methacrylate, which are low-molecular-weight crystalline polymer resins or copolymers of the polyacrylates (for example, n-stearyl acrylate-ethyl methacrylate copolymers); and crystalline polymers containing a long alkyl group in a side chain. One of these brazing materials and waxes may be used alone or two or more of these brazing materials and waxes may be used in combination.

The melting point of the release agent is not particularly limited, may be appropriately selected depending on the intended purpose, and is preferably from 50 degrees C. through 120 degrees C. and more preferably from 60 degrees C. through 90 degrees C. When the melting point of the release agent is 50 degrees C. or higher, the wax can be prevented from adversely affecting heat-resistant storage stability. When the melting point of the release agent is 120 degrees C. or lower, the problem of cold offset during fixing at a low temperature can be effectively prevented. The melt viscosity of the release agent as a measured value at a temperature higher by 20 degrees C. than the melting point of the release agent is preferably from 5 cps through 1,000 cps and more preferably from 10 cps through 100 cps. When the melt viscosity of the release agent is 5 cps or higher, degradation of the releasability can be prevented. When the melt viscosity of the release agent is 1,000 cps or lower, the effects of hot offset resistance and low-temperature fixability can be sufficiently exhibited. The content of the release agent in the toner is not particularly limited, may be appropriately selected depending on the intended purpose, and is preferably from 0% by mass through 40% by mass and more preferably from 3% by mass through 30% by mass. When the content of the release agent is 40% by mass or less, degradation of the flowability of the toner can be prevented.

<<Resin Particles>>

The resin for the resin particles is not particularly limited and may be appropriately selected from known resins depending on the intended purpose, so long as the resin is a resin that can form an aqueous dispersion liquid in an aqueous medium. The resin for the resin particles may be a thermoplastic resin or a thermosetting resins. Usable examples of the resin include vinyl resins, polyurethane resins, epoxy resins, polyester resins, polyamide resins, polyimide resins, silicon resins, phenol resins, melamine resins, urea resins, aniline resins, ionomer resins, and polycarbonate resins. One of these resins may be used alone or two or more of these resins may be used in combination. Among these resins, it is preferable to form an aqueous dispersion liquid of at least one selected from the group consisting of vinyl resins, polyurethane resins, epoxy resins, and polyester resins because it is easy to obtain an aqueous dispersion liquid of minute, spherical resins particles. Vinyl resins are polymers obtained by homopolymerizing or copolymerizing a vinyl monomer. Examples of the vinyl resins include styrene-(meth)acrylic acid ester resins, styrene-butadiene copolymers, (meth)acrylic acid-acrylic acid ester polymers, styrene-acrylonitrile copolymers, styrene-maleic anhydride copolymers, and styrene-(meth)acrylic acid copolymers.

<<Charge Controlling Agent>>

The charge controlling agent that can be used is not particularly limited and may be appropriately selected from known charge controlling agents depending on the intended purpose. Examples of the charge controlling agent include nigrosine-based dyes, triphenylmethane-based dyes, chromium-containing metal complex dyes, molybdic acid chelate pigments, rhodamine-based dyes, alkoxy-based amines, quaternary ammonium salts (including fluorine-modified quaternary ammonium salts), alkyl amides, phosphorus or phosphorus compounds, tungsten or tungsten compounds, fluorosurfactants, metal salts of salicylic acid, and metal salts of salicylic acid derivatives. One of these charge controlling agents may be used alone or two or more of these charge controlling agents may be used in combination.

The charge controlling agent may be a commercially available product. Usable examples of the commercially available product include resins or compounds that contain an electron-donating functional group, azo-dyes, and metal complexes of organic acids. Specific examples of the commercially available product include: a nigrosine-based dye BONTRON 03, a quaternary ammonium salt BONTRON P-51, a metal-containing azo-dye BONTRON S-34, an oxynaphthoic acid metal complex E-82, a salicylic acid-based metal complex E-84, and a phenol-based condensate E-89 (all available from Orient Chemical Industries Co., Ltd.); a salicylic acid-based metal complex TN-105, a quaternary ammonium salt molybdenum complex TP-302, and TP-415 (all available from Hodogaya Chemical Co., Ltd.); a quaternary ammonium salt COPY CHARGE PSY VP2038, a triphenylmethane derivative COPY BLUE PR, a quaternary ammonium salt COPY CHARGE NEG VP2036, and COPY CHARGE NX VP434 (all available from Hoechst AG); LRA-901 and a boron complex LR-147 (both available from Japan Carlit Co., Ltd.); and copper phthalocyanine, perylene, quinacridone, azo-pigments, and other polymeric compounds containing a functional group such as a sulfonic acid group, a carboxyl group, and a quaternary ammonium salt.

It is optional to add the charge controlling agent in the resin phases in the toner particles, by utilizing difference in affinity with the resins in the toner particles. It is possible to suppress spent of the charge controlling agent on other members such as a photoconductor and a carrier, by including the charge controlling agent selectively in the resin phases of the toner particles present in internal layers. A method for producing a toner of the present disclosure is relatively flexible in designing of the location of the charge controlling agent. Therefore, the location may be arbitrarily designed depending on each image forming process.

<<Inorganic Particles>>

The inorganic particles are used as an external additive for imparting, for example, flowability, developability, and a charging property to the toner particles. The inorganic particles are not particularly limited and may be appropriately selected from known inorganic particles depending on the intended purpose. Usable examples of the inorganic particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. One of these kinds of inorganic particles may be used alone or two or more of these kinds of inorganic particles may be used in combination.

As the inorganic particles for supplementing flowability, develop ability, and a charging property of the coloring particles obtained in the present disclosure, it is preferable to also use small-particle-diameter inorganic particles in addition to large-particle-diameter inorganic particles having an average primary particle diameter of from 80 nm through 500 nm. Particularly, hydrophobic silica or hydrophobic titanium oxide or both of hydrophobic silica and hydrophobic titanium oxide is/are preferable. The average primary particle diameter of the inorganic particles is preferably from 5 nm through 50 nm and more preferably from 10 nm through 30 nm. The BET specific surface area of the inorganic particles is preferably from 20 $m^2/g$ through 500 $m^2/g$. The percentage of use of the inorganic particles is preferably from 0.01% by mass through 5% by mass and more preferably from 0.01% by mass through 2.0% by mass of the toner.

<<Flow Improver>>

The flow improver refers to an agent used for surface treatment to improve hydrophobicity and prevent degradation of a flow property and a charging property even under a high humidity. Examples of the flow improver include a silane coupling agent, a silylation agent, a silane coupling agent containing a fluorinated alkyl group, an organic titanate-based coupling agent, an aluminum-based coupling agent, a silicone oil, and a modified silicone oil. It is particularly preferable to subject the silica and titanium oxide to surface treatment with such a flow improver to be used as hydrophobic silica and hydrophobic titanium oxide.

<<Cleanability Improver>>

The cleanability improver refers to an agent added to the toner in order to remove a developer remaining on a photoconductor or a primary transfer medium after transfer. Examples of the cleanability improver include: metal salts of fatty acids such as stearic acid, such as zinc stearate and calcium stearate; and polymer particles produced by soap-free emulsion polymerization, such as polymethyl methacrylate particles and polystyrene particles. Polymer particles having a relatively narrow particle size distribution are preferable. Polymer particles having a volume average particle diameter of from 0.01 micrometers through 1 micrometer are preferable.

<<Magnetic Material>>

The magnetic material is not particularly limited and may be appropriately selected from known magnetic materials depending on the intended purpose. Usable examples of the magnetic material include iron powder, magnetite, and ferrite. Among these magnetic materials, a white magnetic material is preferable in terms of color tone.

<Method for Producing Toner>

As a method for producing a toner, any hitherto used method may be appropriately used so long as the method can satisfy the above requirements defined in the present disclosure.

Examples of a crystalline polyester resin dispersing method or emulsifying method include a method using a mechanical pulverizer, a jet granulating method, and a phase-transfer emulsification method of adding water to a solution obtained by dissolving the crystalline polyester resin in an organic solvent to allow the solution to undergo phase transfer from an oil phase to an aqueous phase.

With the phase-transfer emulsification method, it is easy to control the particle diameter, and it is possible to obtain particles of the crystalline polyester resin having a narrow particle size distribution. The phase-transfer emulsification method is preferred to the use of a mechanical pulverizer, because it is difficult to obtain particles having a narrow particle size distribution with the latter method.

A dissolution suspension method is suitable as a method for introducing the particles of the crystalline polyester resin produced by the phase-transfer emulsification method into the toner. With a pulverizing method or an emulsion aggregation method, it is difficult to keep the spherical shape because these methods use heat during the process. Moreover, these methods have the risk of causing the crystalline polyester resin to be partially plasticized with the non-crystalline resin due to heat.

Furthermore, as described above, adjustment of the SP values of the crystalline polyester resin and the non-crystalline polyester resin also matters.

When the difference ($\Delta SP$) between the SP values of the crystalline polyester resin and the non-crystalline polyester resin is extremely small, the crystalline polyester resin becomes plasticized and compatibilized with the non-crystalline resin, resulting in crystal growth. This makes it impossible to keep spherical shapes. On the other hand, when $\Delta SP$ is extremely large, the crystalline polyester resin does not become plasticized and may not exhibit low-temperature fixability.

In the present disclosure, it is preferable to produce the toner by a producing method including a step of dispersing and granulating in an aqueous medium, an oil phase that contains the crystalline polyester resin, preferably contains the non-crystalline polyester resin that is a prepolymer containing a urethane bond or a urea bond or both of a urethane bond and a urea bond and the non-crystalline polyester resin free of a urethane bond or a urea bond or both of a urethane bond and a urea bond, and further contains, for example, the curing agent, the release agent, and the colorant as needed.

In the toner producing process, a dispersion liquid of the crystalline polyester in water is fed into the oil phase containing the non-crystalline polyesters, and, for example, the curing agent, the release agent, and the colorant, and then the resultant is dispersed in the aqueous medium, to be granulated into the toner. This can adjust the location of presence of the crystalline polyester resin. Here, a hybrid resin of a styrene acrylic resin and a polyester resin is added as a dispersing aid to the oil phase containing the crystalline polyester resin and the non-crystalline polyester resins. This causes the crystalline polyester resin to be drawn into the inside of the toner, and enables adjustment of the location of presence of the crystalline polyester resin that is to be dispersed inside the toner.

By feeding the dispersion liquid of the crystalline polyester resin in water to the aqueous medium or by using the dispersing aid, it is possible to prevent the crystalline polyester resin from being located on the toner surface.

As the method for producing a toner of the present disclosure, it is more preferable to use the dissolution suspension method of forming toner base particles while producing a polyester resin through an elongation reaction or a cross-linking reaction or both of an elongation reaction and a cross-linking reaction of the prepolymer with the curing agent.

Production of the dispersion liquid of the crystalline polyester resin in water by phase-transfer emulsification, and the steps included in the dissolution suspension method, namely, for example, preparation of an aqueous medium, preparation of an oil phase containing toner materials, emulsification or dispersion of toner materials, and removal of an organic solvent will be described in detail below.

<<Preparation of Dispersion Liquid of Crystalline Polyester Resin in Water>>

It is preferable to prepare a dispersion liquid of the crystalline polyester resin in water by phase-transfer emulsification.

The phase-transfer emulsification method is a method of adding, as needed, an organic solvent, a neutralizer, and a surfactant to the resin, dropping an aqueous medium to the resultant under stirring to obtain emulsified particles, and then removing the organic solvent in the resin dispersion liquid to obtain an emulsified liquid. As needed, it is possible to perform heating.

The organic solvent is not particularly limited and may be appropriately selected depending on the intended purpose. Examples of the organic solvent include methanol, ethanol, propanol, IPA, butanol, ethyl acetate, MEK, and any combination of these organic solvents. An organic solvent having a boiling point of lower than 150 degrees C. is preferable because it is easy to remove such an organic solvent.

As the neutralizer, ordinary acids and alkalis such as nitric acid, hydrochloric acid, sodium hydroxide, and ammonia can be used.

The method for removing the organic solvent is not particularly limited and may be appropriately selected depending on the intended purpose. Examples of the method include a method of gradually raising the temperature of the whole reaction system to evaporate the organic solvent in the oil droplets, and a method of spraying the dispersion liquid to a dry atmosphere to remove the organic solvent in the oil droplets.

As the surfactant, one, two, or more kinds of surfactants may be used. The surfactant may be selected from ionic surfactants and nonionic surfactants. Here, it is to be understood that the "ionic surfactants" encompass anionic surfactants and cationic surfactants.

<<Preparation of Aqueous Medium (Aqueous Phase)>>

It is possible to prepare the aqueous medium by dispersing, for example, resin particles in an aqueous medium. The amount of the resin particles to be added in the aqueous medium is not particularly limited, may be appropriately selected depending on the intended purpose, and is preferably from 0.5 parts by mass through 10 parts by mass relative to 100 parts by mass of the aqueous medium.

The aqueous medium is not particularly limited and may be appropriately selected depending on the intended purpose. Examples of the aqueous medium include water, a solvent miscible with water, and a mixture of the water and the solvent. One of these aqueous media may be used alone or two or more of these aqueous media may be used in combination. Among these aqueous media, water is preferable.

The solvent miscible with water is not particularly limited and may be appropriately selected depending on the intended purpose. Examples of the solvent include alcohols, dimethyl formamide, tetrahydrofuran, cellosolves, and lower ketones. Examples of the alcohols include methanol, isopropanol, and ethylene glycol. Examples of the lower ketones include acetone and methyl ethyl ketone.

<<Preparation of Oil Phase>>

It is possible to prepare the oil phase containing toner materials, by dissolving or dispersing in an organic solvent, toner materials including the non-crystalline polyester resin that is a prepolymer containing a urethane bond or a urea bond or both of a urethane bond and a urea bond, the non-crystalline polyester resin free of a urethane bond or a urea bond or both of a urethane bond and a urea bond, and the crystalline polyester resin, and further including, for example, the curing agent, the release agent, and the colorant.

The organic solvent is not particularly limited and may be appropriately selected depending on the intended purpose. An organic solvent having a boiling point of lower than 150 degrees C. is preferable because it is easy to remove such an organic solvent.

Examples of the organic solvent having a boiling point of lower than 150 degrees C. include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone.

One of these organic solvents may be used alone or two or more of these organic solvents may be used in combination.

Among these organic solvents, for example, ethyl acetate, toluene, xylene, benzene, methylene chloride, 1,2-dichloroethane, chloroform, and carbon tetrachloride are preferable, and ethyl acetate is more preferable.

<<Emulsification or Dispersion>>

It is possible to emulsify or disperse the toner materials, by dispersing in the aqueous medium, the oil phase containing the toner materials and the dispersion liquid of the crystalline polyester resin in water.

(Mode i) It is possible to disperse the dispersion liquid of the crystalline polyester resin in water in the oil phase after mixing the dispersion liquid with the aqueous medium beforehand.

(Mode ii) It is possible to disperse dispersion liquid of the crystalline polyester resin in water in the aqueous medium after mixing the dispersion liquid with the oil phase beforehand.

(Mode ii) is more preferable for favorable dispersion of the crystalline polyester resin inside the toner.

During emulsification or dispersion of the toner materials, the curing agent and the prepolymer can be allowed to undergo an elongation reaction or a cross-linking reaction or both of an elongation reaction and a cross-linking reaction.

The reaction conditions (a reaction time and a reaction temperature) for producing the prepolymer are not particularly limited and may be appropriately selected depending on the combination of the curing agent and the prepolymer. The reaction time is preferably from 10 minutes through 40 hours and more preferably from 2 hours through 24 hours. The reaction temperature is preferably from 0 degrees C. through 150 degrees C. and more preferably from 40 degrees C. through 98 degrees C.

The method for stably forming a dispersion liquid containing the prepolymer in the aqueous medium is not particularly limited and may be appropriately selected depending on the intended purpose. Examples of the method include a method of adding in the aqueous medium, an oil phase prepared by dissolving or dispersing the toner materials in a solvent, and dispersing the oil phase with a shear force.

The disperser for the dispersing is not particularly limited and may be appropriately selected depending on the intended purpose. Examples of the disperser include a low-speed shearing disperser, a high-speed shearing disperser, a friction disperser, a high-pressure jet disperser, and an ultrasonic disperser. Among these dispersers, a high-speed shearing disperser is preferable because the high-speed shearing disperser can control the particle diameter of the dispersed element (oil droplets) to a particle diameter of from 2 micrometers through 20 micrometers.

In use of the high-speed shearing disperser, it is possible to appropriately select the conditions such as the rotation number, the dispersion time, and the dispersion temperature depending on the intended purpose.

The rotation number is preferably from 1,000 rpm through 30,000 rpm and more preferably from 5,000 rpm through 20,000 rpm. The dispersion time is preferably from 0.1 minutes through 5 minutes in the case of a batch system. The dispersion temperature is preferably from 0 degrees C. through 150 degrees C. and more preferably from 40 degrees C. through 98 degrees C. under pressurization. Generally, dispersing is smoother at a higher dispersion temperature.

The amount of the aqueous medium to be used for emulsifying or dispersing the toner materials is not particularly limited, may be appropriately selected depending on the intended purpose, and is preferably from 50 parts by mass through 2,000 parts by mass and more preferably from 100 parts by mass through 1,000 parts by mass relative to 100 parts by mass of the toner materials. When the amount of the aqueous medium to be used is 50 parts by mass or greater, the toner materials can be prevented from being poorly dispersed. This makes it possible to obtain toner base particles having a predetermined particle diameter. When the amount of the aqueous medium to be used is 2,000 parts by mass or lower, the production cost can be saved.

For emulsification or dispersion of the oil phase containing the toner materials, it is preferable to use a dispersant in terms of stabilizing the dispersed elements such as oil droplets and imparting a desired shape and a sharp particle size distribution to the dispersed elements.

The dispersant is not particularly limited and may be appropriately selected depending on the intended purpose. Examples of the dispersant include a surfactant, a sparingly-water-soluble inorganic compound dispersant, and a polymeric protective colloid. One of these dispersants may be used alone or two or more of these dispersants may be used in combination. Among these dispersants, a surfactant is preferable.

The surfactant is not particularly limited and may be appropriately selected depending on the intended purpose. Usable examples of the surfactant include anionic surfactants, cationic surfactants, nonionic surfactants, and amphoteric surfactants. Examples of the anionic surfactants include alkyl benzene sulfonate, α-olefin sulfonate, and phosphoric acid ester. Among these surfactants, surfactants containing a fluoroalkyl group are preferable.

<<Removal of Organic Solvent>>

The method for removing the organic solvent from the dispersion liquid of, for example, the emulsified slurry is not particularly limited and may be appropriately selected depending on the intended purpose. Examples of the method include a method of gradually raising the temperature of the whole reaction system to evaporate the organic solvent in the oil droplets, and a method of spraying the dispersion liquid to a dry atmosphere to remove the organic solvent in the oil droplets.

When the organic solvent is removed, there are formed toner base particles. The toner base particles can be subjected to, for example, washing and drying, and further to, for example, classification. The classification may be performed by removing fine particles with, for example, a cyclone or a decanter or by, for example, centrifugation in a liquid.

The obtained toner base particles may be mixed with particles of, for example, the external additive and the charge controlling agent. Here, a mechanical impact may be applied. This makes it possible to suppress the particles of, for example, the external additive from being detached from the surface of the toner base particles.

The method for applying the mechanical impact is not particularly limited and may be appropriately selected depending on the intended purpose. Examples of the method include a method of applying an impact to the mixture with a blade rotating at a high speed, and a method of feeding the mixture to a high-speed air current to accelerate the mixture and make the particles collide on each other or collide on a suitable impact board.

The device used for the method is not particularly limited and may be appropriately selected depending on the intended purpose. Examples of the device include an ang-mill (available from Hosokawa Micron Corporation), a device obtained by remodeling an I-type mill (available from Nippon Pneumatic Mfg. Co., Ltd.) to have a lower pulverization air pressure, a hybridization system (available from Nara Machinery Co., Ltd.), a kryptron system (available from Kawasaki Heavy Industries, Ltd.), and an automatic mortar.

(Developer)

A developer of the present disclosure contains at least the toner described above, and further contains other components appropriately selected as needed, such as a carrier.

Therefore, it is possible to provide a developer that can ensure toner flowability suitably even in a high-temperature, high-humidity environment, can be suitably developed and transferred with low contamination to a developing member, and has a high environmental stability (reliability).

The developer may be a one-component developer or a two-component developer. For use with, for example, a high-speed printer adapted to the recent improved information processing speed, a two-component developer is preferable for a longer life.

When the developer is used as a one-component developer, the particle diameter of the toner does not change much even through toner supply and consumption, there occur little filming of the toner on a developing roller and little adhesion of a toner melt to a member such as a blade configured to thin the toner into a thin layer, and the developer can provide good, stable developability and images even through a long time of stirring in a developing device.

When the developer is used as a two-component developer, the particle diameter of the toner does not change much even through a long term of toner supply and consumption, and the developer can provide good, stable developability and images even through a long time of stirring in a developing device.

<Carrier>

The carrier is not particularly limited and may be appropriately selected depending on the intended purpose. A carrier containing a core material and a resin layer coating the core material is preferable.

—Core Material—

The constituent material of the core material is not particularly limited and may be appropriately selected depending on the intended purpose. Examples of the constituent material of the core material include manganese-strontium-based materials of from 50 emu/g through 90 emu/g and manganese-magnesium-based materials of from 50 emu/g through 90 emu/g. It is preferable to use a highly magnetized material such as an iron powder of 100 emu/g or higher and magnetite of from 75 emu/g through 120 emu/g in order to ensure an image density. Furthermore, it is preferable to use a lowly magnetized material such as a copper-zinc-based material of from 30 emu/g through 80 emu/g because such a material can alleviate an impact to be given to a photoconductor by the developer which is being in a chain-like form and is advantageous for improving image quality.

One of these materials may be used alone or two or more of these materials may be used in combination.

The volume average particle diameter of the core material is not particularly limited, may be appropriately selected depending on the intended purpose, and is preferably from 10 micrometers through 150 micrometers and more preferably from 40 micrometers through 100 micrometers. When the volume average particle diameter of the core material is 10 micrometers or greater, it is possible to effectively prevent a problem that a high percentage of minute particles in the carrier may lead to a low magnetization per particle and consequent scattering of the carrier. On the other hand, when the volume average particle diameter of the core material is 150 micrometers or less, it is possible to effectively prevent a problem that a poor specific surface area that may be accompanied by toner scattering may lead to a poor reproducibility, particularly at solid portions in a full-color image including many solid portions.

The toner of the present disclosure can be mixed with the carrier and used as a developer.

The content of the carrier in the two-component developer is not particularly limited, may be appropriately selected depending on the intended purpose, and is preferably from 90 parts by mass through 98 parts by mass and more preferably from 93 parts by mass through 97 parts by mass relative to 100 parts by mass of the two-component developer.

The developer of the present disclosure can be suitably used for image formation by various known electrophotography methods such as a magnetic one-component developing method, a non-magnetic one-component developing method, and a two-component developing method.

(Toner Stored Unit)

A toner stored unit of the present disclosure refers to a unit that has a function for storing a toner and in which a toner is stored. Example of the form of the toner stored unit include a toner stored container, a developing device, and a process cartridge.

The toner stored container refers to a container in which a toner is stored.

The developing device refers to a device including a unit configured to store a toner and perform development.

The process cartridge refers to an integrated body of at least an electrostatic latent image bearer (also referred to as image bearer) and a developing unit, storing a toner, and capable of being attached to and detached from an image forming apparatus. The process cartridge may further include at least one selected from the group consisting of a charging unit, an exposing unit, and a cleaning unit.

Image formation with an image forming apparatus to which the toner stored unit of the present disclosure is attached enables image formation that takes advantage of the features of the toner that is excellent in image quality while also having an excellent low-temperature fixability and an excellent heat-resistant storage stability.

(Image Forming Apparatus and Image Forming Method)

An image forming apparatus of the present disclosure includes an electrostatic latent image bearer, an electrostatic latent image forming unit, and a developing unit, and further includes other units as needed.

An image forming method of the present disclosure includes at least an electrostatic latent image forming step and a developing step, and further includes other steps as needed.

The image forming method can be suitably performed by the image forming apparatus. The electrostatic latent image forming step can be suitably performed by the electrostatic latent image forming unit. The developing step can be suitably performed by the developing unit. The other steps can be suitably performed by the other units.

The image forming apparatus of the present disclosure more preferably includes: an electrostatic latent image bearer; an electrostatic latent image forming unit configured to form an electrostatic latent image on the electrostatic latent image bearer; a developing unit including a toner and configured to develop the electrostatic latent image formed on the electrostatic latent image bearer with the toner to form a toner image; a transfer unit configured to transfer the toner image formed on the electrostatic latent image bearer onto a surface of a recording medium; and a fixing unit configured to fix the toner image transferred onto the surface of the recording medium.

The image forming method of the present disclosure more preferably includes: an electrostatic latent image forming step of forming an electrostatic latent image on an electrostatic latent image bearer; a developing step of developing the electrostatic latent image formed on the electrostatic latent image bearer with a toner to form a toner image; a transfer step of transferring the toner image formed on the electrostatic latent image bearer onto a surface of a recording medium; and a fixing step of fixing the toner image transferred onto the surface of the recording medium.

The toner described above is used by the developing unit and in the developing step. It is preferable to form the toner image with the use of a developer that contains the toner and further contains other components such as a carrier as needed.

Next, one mode of the image forming apparatus of the present disclosure will be described with reference to FIG. 1. A color image forming apparatus 100A illustrated in FIG. 1 includes a photoconductor drum 10 (hereinafter may be referred to as "photoconductor 10") serving as the electrostatic latent image bearer; a charging roller 20 serving as the charging unit; an exposing device 30 serving as the exposing unit; a developing device 40 serving as the developing unit; an intermediate transfer medium 50; a cleaning device 60 serving as the cleaning unit and including a cleaning blade; and a charge eliminating lamp 70 serving as a charge eliminating unit.

The intermediate transfer medium 50 is an endless belt and designed to be capable of being moved in the direction of an arrow by 3 rollers 51 disposed within the endless belt to make the endless belt tense. Some of the 3 rollers 51 also function as a transfer bias roller capable of applying a predetermined transfer bias (primary transfer bias) to the intermediate transfer medium 50. A cleaning device 90 including a cleaning blade is disposed adjacently to the intermediate transfer medium 50. A transfer roller 80 serving as the transfer unit and capable of applying a transfer bias for transfer (secondary transfer) of a developed image (toner image) onto a transfer sheet 95 serving as a recording medium is disposed adjacently to the intermediate transfer medium 50 in a manner to face the intermediate transfer medium 50. A corona charging device 58 configured to impart electric charges to a toner image on the intermediate transfer medium 50 is disposed on the circumference of the intermediate transfer medium 50 at a middle position, seen in the rotation direction of the intermediate transfer medium 50, between the position at which the photoconductor 10 and the intermediate transfer medium 50 contact each other and the position at which the intermediate transfer medium 50 and the transfer sheet 95 contact each other.

The developing device 40 includes a developing belt 41 serving as a developer bearer, and a black (Bk) developing unit 45K, a yellow (Y) developing unit 45Y, a magenta (M) developing unit 45M, and a cyan (C) developing unit 45C that are arranged side by side on the circumference of the developing belt 41. The black developing unit 45K includes a developer container 42K, a developer supplying roller 43K, and a developing roller 44K. The yellow developing unit 45Y includes a developer container 42Y, a developer supplying roller 43Y, and a developing roller 44Y. The magenta developing unit 45M includes a developer container 42M, a developer supplying roller 43M, and a developing roller 44M. The cyan developing unit 45C includes a developer container 42C, a developer supplying roller 43C, and a developing roller 44C. The developing belt 41 is an endless belt, is made tense in a rotatable manner by a plurality of belt rollers, and partially contacts the electrostatic latent image bearer 10.

A specific mode of the image forming method will be described below.

Image signals corresponding to 4 colors of Y (yellow), M (magenta), C (cyan), and K (black) are generated based on image data sent to an image processing unit (hereinafter referred to as "IPU").

Next, the image processing unit sends the Y, M, C, and K image signals to a wiring unit. The writing unit modulates and scans 4 laser beams for Y, M, C, and K, such that after photoconductor drums are charged by the charging unit, electrostatic latent images are formed on the photoconductor drums sequentially. Here, for example, a first photoconductor drum corresponds to K, a second photoconductor drum corresponds to Y, a third photoconductor drum corresponds to M, and a fourth photoconductor drum corresponds to C.

Next, the developing units serving as developer attaching units form toner images of the respective colors on the photoconductor drums. A transfer sheet fed by a paper feeding unit is conveyed over a transfer belt, such that the toner images on the photoconductor drums are transferred sequentially by a transfer charger onto the transfer sheet.

After the transfer step is completed, the transfer sheet is conveyed to a fixing unit, and the fixing unit fixes the transferred toner images on the transfer sheet.

After the transfer step is completed, any toner remaining on the photoconductor drums is removed by a cleaning unit.

EXAMPLES

The present disclosure will be described below by way of Examples. The present disclosure should not be construed as being limited to these Examples. Unless otherwise explicitly specified, "part" represents "part by mass". Unless otherwise explicitly specified, "%" represents "% by mass".

Production Example A: Synthesis of Non-crystalline Polyester Resin A

A four-necked flask equipped with a nitrogen introducing tube, a dehydrating tube, a stirrer, and a thermocouple was charged with a bisphenol A-ethylene oxide 2-mol adduct (BisA-EO), a bisphenol A-propylene oxide 3-mol adduct (BisA-PO), trimethylolpropane (TMP), terephthalic acid, and adipic acid. The ratio by mole among the bisphenol A-ethylene oxide 2-mol adduct, the bisphenol A-propylene oxide 3-mol adduct, and trimethylolpropane (bisphenol A-ethylene oxide 2-mol adduct/bisphenol A-propylene oxide 3-mol adduct/trimethylolpropane) was set to 38.6/57.9/3.5. The ratio by mole between terephthalic acid and adipic acid (terephthalic acid/adipic acid) was set to 80/20. OH/COOH, which was a ratio by mole between hydroxyl group and carboxyl group, was set to 1.2. The materials were allowed to undergo a reaction together with titanium tetraisopropoxide (500 ppm relative to the resin components) at normal pressure at 230 degrees C. for 8 hours. The materials were further allowed to undergo a reaction at a reduced pressure of from 10 mmHg through 15 mmHg for 4 hours. Subsequently, trimellitic anhydride was fed into the reaction vessel in an amount of 1 mol % of all of the resin components. The materials were allowed to undergo a reaction at 180 degrees C. at normal pressure for 3 hours. In this way, [Non-crystalline polyester resin A] was obtained. [Non-crystalline polyester resin A] had a SP value of 11.2, Tg of 57.6 degrees C., Mw of 10,000, and an acid value of 20.

Production Example B: Synthesis of Prepolymer B

A reaction vessel equipped with a cooling tube, a stirrer, and a nitrogen introducing tube was charged with 3-methyl-1,5-pentanediol (97 mol %) and trimethylolpropane (TMP) (3 mol %) as alcohol components, and adipic acid (50 mol %) and terephthalic acid (50 mol %) as acid components. Here, the materials were adjusted such that OH/COOH=1.1. Titanium tetraisopropoxide (300 ppm relative to the resin components) was also fed to the reaction vessel. Subsequently, the temperature was raised to 200 degrees C. for about 4 hours, and then raised to 230 degrees C. for 2 hours, to allow the materials to undergo a reaction until there was no longer any water to be discharged. Subsequently, the materials were allowed to undergo a reaction at a reduced pressure of from 10 mmHg through 15 mmHg for 5 hours, to obtain [Intermediate polyester B-1].

Next, a reaction vessel equipped with a cooling tube, a stirrer, and a nitrogen introducing tube was charged with [Intermediate polyester B-1] and isophorone diisocyanate (IPDI) at a ratio by mole (isocyanate group of IPDI/hydroxyl group of Intermediate polyester) of 1.8. The materials were diluted with ethyl acetate to be a 48% ethyl acetate solution, which was then allowed to undergo a reaction at 100 degrees C. for 5 hours, to obtain a nonlinear polyester resin B [Prepolymer B] containing a reactive group. [Prepolymer B] had Tg of −38.5 degrees C., Mw of 12,000, and an acid value of 0.14.

Production Example C: Synthesis of Crystalline Polyester Resin C-1

A 5 L four-necked flask equipped with a nitrogen introducing tube, a dehydrating tube, a stirrer, and a thermocouple was charged with 1,10-decanediol and dodecanedioic acid such that a ratio (OH/COOH) of OH group to COOH group would be 1.1. Together with 500 ppm of titanium tetraisopropoxide relative to the mass of the charged materials, the materials were allowed to undergo a reaction for 1 hour while discharging water, in a manner that the temperature would be raised to 235 degrees C. at the end. Subsequently, the resultant was allowed to undergo a reaction at a reduced pressure of 10 mmHg or lower for 6 hours. Subsequently, with the temperature set to 185 degrees C., trimellitic anhydride was added such that a ratio by mole to COOH group would be 0.053, and the materials were allowed to undergo a reaction for 2 hours under stirring, to obtain [Crystalline polyester resin C-1].

The acid value (AV), SP value, and melting point (Tm) of the obtained resin are presented in Table 1.

Production Example C: Synthesis of Crystalline Polyester Resins C-2 to C-6

In the same manner as in the synthesis of Crystalline polyester resin C-1, Crystalline polyester resins C-2 to C-6 were synthesized with the materials and synthesis conditions presented in Table 1 below.

TABLE 1

| | | C-1 | C-2 | C-3 | C-4 | C-5 | C-6 | C-7 |
|---|---|---|---|---|---|---|---|---|
| Composition (ratio by mole) | 1,10-decanediol | 1.1 | | | | | | |
| | 1,9-nonanediol | | 1.1 | 1.1 | | | | |
| | 1,6-hexanediol | | | | 1.1 | 1.1 | 1.1 | |
| | 1,4-butanediol | | | | | | | 1.1 |
| | Dodecanedioic acid | 1.0 | 1.0 | 1.0 | 1.0 | 1.0 | | |
| | Sebaccic acid | | | | | | 1.0 | |
| | Fumaric acid | | | | | | | 1.0 |
| | Trimollitic anhydride | 0.053 | 0.047 | 0.086 | 0.044 | 0.075 | 0.071 | 0.023 |
| AV [mgKOH/g] | | 15 | 14 | 25 | 15 | 25 | 26 | 14 |
| SP value [—] | | 9.58 | 9.61 | 9.70 | 9.78 | 9.85 | 9.98 | 10.64 |
| ΔSP [—] | | 1.62 | 1.59 | 1.50 | 1.42 | 1.35 | 1.22 | 0.56 |
| Molecular weight (Mw) [—] | | 12,000 | 10,000 | 10,000 | 13,000 | 13,000 | 14,000 | 10,000 |
| Melting point [degree C.] | | 78 | 71 | 71 | 75 | 75 | 65 | 120 |

Production Example D: Synthesis of Styrene Acrylic/Polyester Hybrid Resin D

Polyoxypropylene (2.2)-2,2-(4-hydroxyphenyl)propane (1,225 g), polyoxyethylene (2.0)-2,2-(4-hydroxyphenyl)propane (485 g), terephthalic acid (345 g), and isododecenyl succinic acid (250 g), which were condensation-polymerizable resin material monomers, and dibutyl tin oxide (5 g), which was an esterification catalyst, were allowed to undergo condensation polymerization in a nitrogen atmosphere at 230 degrees C. for 6 hours. Subsequently, the resultant was cooled to 150 degrees C. Trimellitic acid (175 g) was added to the reaction vessel. Subsequently, a mixture of styrene (400 g) and 2-ethylhexyl acrylate (55 g), which were addition-polymerizable resin material monomers, acrylic resin (35 g), which was an ambifunctional compound, and dicumyl peroxide (25 g), which was a polymerization initiator, was dropped for 1 hour under stirring at 160 degrees C. With the same temperature kept for another 1 hour, the materials were allowed to undergo an addition polymerization reaction. Subsequently, at a raised temperature of 200 degrees C., the materials were allowed to undergo a condensation polymerization reaction, to obtain [Styrene acrylic/polyester hybrid resin D]. The hybrid resin had a glass transition temperature of 60 degrees C. and an acid value of 21 mgKOH/g.

Example 1

<Preparation of Masterbatch (MB)>

Water (600 parts by mass), carbon black (NIPEX 60 available from Degussa AG) (500 parts by mass), and Non-crystalline polyester resin A (500 parts by mass) were added together and mixed with a Henschel mixer (available from Mitsui Mining Co., Ltd.). The mixture was kneaded with 2 rolls at 150 degrees C. for 30 minutes, then rolled and cooled, and pulverized with a pulverizer, to obtain [Masterbatch 1].

<Synthesis of Organic Particle Emulsion (Particle Dispersion Liquid)>

A reaction vessel equipped with a stirring bar and a thermometer was charged with water (683 parts), sodium salt of methacrylic acid-ethylene oxide adduct sulfate (ELEMINOL RS-30: available from Sanyo Chemical Industries, Ltd.) (11 parts), styrene (138 parts), methacrylic acid (138 parts), and ammonium persulfate (1 part). The materials were stirred at 400 rpm for 15 minutes. As a result, a white emulsion was obtained. The white emulsion was allowed to undergo a reaction for 5 hours under heating to raise the temperature in the system to 75 degrees C. Further, a 1% ammonium persulfate aqueous solution (30 parts) was added, and the materials were aged at 75 degrees C. for 5 hours, to obtain [Particle dispersion liquid], which was an aqueous dispersion liquid of a vinyl-based resin (a copolymer of styrene-methacrylic acid-sodium salt of methacrylic acid-ethylene oxide adduct sulfate).

The volume average particle diameter of [Particle dispersion liquid] measured with LA-920 (available from HORIBA Ltd.) was 0.14 micrometers.

<Preparation of Aqueous Phase>

Water (2,240 parts), [Particle dispersion liquid] (80 parts), a 48.5% sodium dodecyldiphenyl ether disulfonate aqueous solution (ELEMINOL MON-7: available from Sanyo Chemical Industries, Ltd.) (80 parts), and ethyl acetate (200 parts) were mixed and stirred, to obtain a milky-white liquid, which was used as [Aqueous phase].

<Production of WAX Dispersion Liquid>

A container equipped with a stirring bar and a thermometer was charged with an ester wax (100 parts) (available from NOF Corporation, WEP-3, with a melting point of 70 degrees C. and an acid value of 0.1 mgKOH/g), which was a release agent, and ethyl acetate (400 parts). The materials were heated to 80 degrees C. under stirring, retained at 80 degrees C. for 5 hours, cooled to 20 degrees C. for 1 hour, and then subjected to dispersion treatment using a bead mill (ULTRAVISCO MILL, available from Imex Co., Ltd.) at a liquid sending rate of 1 kg/hr, a disk peripheral velocity of 6 m/second, with 0.5 mm zirconia beads packed to 80% by volume, and at the number of passes of 3, to obtain [WAX dispersion liquid].

<Production of Crystalline Polyester Resin Dispersion Liquid C-1a>

[Crystalline polyester resin C-1] (40 parts by mass), methyl ethyl ketone (24 parts by mass), and 2-propyl alcohol (4 parts by mass) were added into a four-necked flask. Subsequently, the materials were stirred under heating at the melting point of [Crystalline polyester resin C-1], to dissolve the crystalline polyester resin. Subsequently, a 10% by mass ammonia aqueous solution was added such that the neutralization rate would be 150%. The neutralization rate was calculated from the acid value of the crystalline polyester resin. Furthermore, ion-exchanged water (160 parts by mass) was added in a gradual manner, to allow the materials to undergo phase-transfer emulsification. Subsequently, the resultant was desolventized. Subsequently, ion-exchanged water was added to adjust the solid concentration (concentration of the crystalline polyester resin) to 25% by mass, to obtain [Crystalline polyester resin dispersion liquid C-1a], which was a toner binder resin dispersion. The particle diameter of the crystalline polyester resin in [Crystalline polyester resin dispersion liquid C-1a] is presented in Table 2 below.

<Preparation of Oil Phase>

[Ethyl acetate] (302 parts), [WAX dispersion liquid 1] (250 parts), [Crystalline polyester resin dispersion liquid C-1a] (500 parts), [Non-crystalline polyester resin A], and [Styrene acrylic/polyester hybrid resin D] (125 parts), and [Masterbatch 1] (100 parts) were added into a container.

The materials were mixed with a TK homomixer (available from Primix Corporation) at 5,000 rpm for 60 minutes. Subsequently, [Ethyl acetate solution of Prepolymer B] (300 parts), and isophoronediamine (2 parts), which was a curing agent, were added, and the materials were mixed with a TK homomixer (available from Primix Corporation) at 5,000 rpm for 1 minute, to obtain [Oil phase].

Here, the amounts of [Non-crystalline polyester resin A] and [Prepolymer B] to be added were adjusted such that the content ratio X (=A/C) of the content (A) of the non-crystalline polyester resin to the content (C) of the crystalline polyester resin in the toner to be produced would be 95/5.

<Emulsification/Desolventization>

[Oil phase] was added into a container in which [Aqueous phase] (2,600 parts) was poured, and mixed with a TK homomixer at a rotation number of 13,000 rpm for 3 minutes, to obtain [Emulsified slurry]. Here, the volume average particle diameter to be obtained after desolventization was adjusted to 5.5 micrometers.

[Emulsified slurry] was fed into a container equipped with a stirrer and a thermometer, desolventized at 30 degrees C. for 8 hours, and aged at 45 degrees C. for 4 hours, to obtain [Dispersed slurry].

<Washing/Drying>

[Dispersed slurry] (100 parts) was filtrated at a reduced pressure, and then subjected to the operations of (1) to (4) below twice, to obtain [Filtration cake].

(1): Ion-exchanged water (100 parts) was added to the filtration cake. The resultant was mixed with a TK homomixer (at a rotation number of 12,000 rpm for 10 minutes), and then filtrated.

(2): A 10% sodium hydroxide aqueous solution (100 parts) was added to the filtration cake of (1). The resultant was mixed with a TK homomixer (at a rotation number of 12,000 rpm for 30 minutes), and then filtrated at a reduced pressure.

(3): A 10% hydrochloric acid (100 parts) was added to the filtration cake of (2). The resultant was mixed with a TK homomixer (at a rotation number of 12,000 rpm for 10 minutes), and then filtrated.

(4): Ion-exchanged water (300 parts) was added to the filtration cake of (3). The resultant was mixed with a TK homomixer (at a rotation number of 12,000 rpm for 10 minutes).

Next, [Filtration cake] was dried with an air-circulating dryer at 45 degrees C. for 48 hours, and sieved through a mesh having a mesh size of 75 micrometers, to obtain [Toner base particles].

<External Adding Treatment>

The toner base particles (100 parts), hydrophobic silica having an average particle diameter of 100 nm (0.6 parts), titanium oxide having an average particle diameter of 20 nm (1.0 part), and hydrophobic silica powder having an average particle diameter of 15 nm (0.8 parts) were mixed with a Henschel mixer, to obtain a toner.

<Production of Crystalline Polyester Resin Dispersion Liquids C-2a to C-6a, C-1b to C-2b, and C-2c>

In the same manner as in the synthesis of Crystalline polyester resin dispersion liquid C-1a described above, [Crystalline polyester resin dispersion liquids C-2a to C-6a], which were dispersion liquids of [Crystalline polyester resins C-2 to C-6], were produced as presented in Table 2 below.

With the use of [Crystalline polyester resins C-1 and C-2], [Crystalline polyester resin dispersion liquids C-1b and C-2b] were produced in the same manner, except that the neutralization rate described in <Production of Crystalline polyester resin dispersion liquid C-1a> described above was changed to 100%.

With the use of [Crystalline polyester resin C-2], [Crystalline polyester resin dispersion liquid C-2c] was produced in the same manner, except that "when there was a viscosity increase during addition of ion-exchanged water in a gradual manner" in the producing method described in <Production of Crystalline polyester resin dispersion liquid C-1a>, "a shear force was applied with a TK homomixer (available from Primix Corporation) at 10,000 rpm".

The particle diameters of the crystalline polyester resins in [Crystalline polyester resin dispersion liquids C-2a to C-6a, C-1b and C-2b, and C-2c] are presented in Table 2 below.

TABLE 2

| | Crystalline polyester resin | Crystalline polyester resin dispersion liquid | Particle diameter (nm) of crystalline polyester resin dispersion liquid |
|---|---|---|---|
| Ex. 1 | C-1 | C-1a | 214 |
| Exs. 2 and 6 to 8 | C-2 | C-2a | 303 |
| Ex. 3 | C-3 | C-3a | 120 |
| Ex. 4 | C-1 | C-1b | 491 |
| Ex. 5 | C-5 | C-5a | 243 |
| Comp. Ex. 1 | C-4 | C-4a | 412 |
| Comp. Ex. 2 | C-2 | C-2b | 530 |
| Comp. Ex. 3 | C-6 | C-6a | 178 |
| Comp. Ex. 4 | C-2 | C-2c | 49 |
| Comp. Ex. 5 | C-7 | C-7 | 300 |

Example 2

A toner was obtained in the same manner as in Example 1, except that the crystalline polyester resin used in Example 1 was changed to C-2.

Example 3

A toner was obtained in the same manner as in Example 1, except that the crystalline polyester resin used in Example 1 was changed to C-3.

Example 4

A toner was obtained in the same manner as in Example 1, except that the neutralization rate in <Production of Crystalline polyester resin dispersion liquid> was changed to 100%, to obtain <Crystalline polyester resin dispersion liquid C-1b>.

Example 5

A toner was obtained in the same manner as in Example 1, except that the crystalline polyester resin used in Example 1 was changed to C-5.

Example 6

A toner was obtained in the same manner as in Example 2, except that unlike in Example 2, the content of [Non-crystalline polyester resin A] in <Preparation of Oil phase> was changed such that the content ratio X (=A/C) of the content (A) of the non-crystalline polyester resin to the content (C) of the crystalline polyester resin in the toner to be produced would be 85/15.

Example 7

A toner was obtained in the same manner as in Example 2, except that unlike in Example 2, the content of [Non-crystalline polyester resin A] in <Preparation of Oil phase> was changed such that the content ratio X (=A/C) of the content (A) of the non-crystalline polyester resin to the content (C) of the crystalline polyester resin in the toner to be produced would be 70/30.

Example 8

A toner was obtained in the same manner as in Example 2, except that unlike in Example 2, the content of [Non-crystalline polyester resin A] in <Preparation of Oil phase> was changed such that the content ratio X (=A/C) of the content (A) of the non-crystalline polyester resin to the content (C) of the crystalline polyester resin in the toner to be produced would be 65/35.

Comparative Example 1

A toner was obtained in the same manner as in Example 1, except that the crystalline polyester resin used in Example 1 was changed to C-4.

Comparative Example 2

A toner was obtained in the same manner as in Example 1, except that the crystalline polyester resin used in Example 1 was changed to C-2 and the neutralization rate in <Production of Crystalline polyester resin dispersion liquid> was changed to 100%, to obtain <Crystalline polyester resin dispersion liquid C-2b>.

Comparative Example 3

A toner was obtained in the same manner as in Example 1, except that the crystalline polyester resin used in Example 1 was changed to C-6.

Comparative Example 4

A toner was obtained in the same manner as in Example 1, except that the crystalline polyester resin used in Example 1 was changed to C-2, and when there was a viscosity increase during addition of ion-exchanged water in a gradual manner in <Production of Crystalline polyester resin dispersion liquid>, a shear force was applied with a TK homomixer (available from Primix Corporation) at 10,000 rpm, to obtain <Crystalline polyester resin dispersion liquid C-2c>.

Comparative Example 5

A toner was obtained in the same manner as in Example 1, except that the crystalline polyester resin used in Example 1 was changed to C-7, and <Production of Crystalline polyester resin dispersion liquid> was changed to as described below.

[Crystalline polyester resin C-7] (100 g), [Non-crystalline polyester resin A] (100 g), and ethyl acetate (400 g) were put in a 2 L metallic container, dissolved by heating at 77 degrees C., and then quenched in an ice-water bath at a rate of 27 degrees C./minute. With glass beads (3 mmϕ) added in an amount of 500 mL, the resultant was pulverized with a batch-type sand mill device (available from Kanpe Hapio Co., Ltd.) for 12 hours, to obtain [Crystalline polyester resin dispersion liquid C-7] having a volume average particle diameter of 0.3 micrometers.

<Production of Carrier>

A silicone resin (organo straight silicone) (100 parts), γ-(2-aminoethyl)aminopropyl trimethoxysilane (5 parts), and carbon black (10 parts) were added to toluene (100 parts), and dispersed with a homomixer for 20 minutes, to prepare a resin layer coating liquid. With a fluidized bed-type coater, the resin layer coating liquid was coated on a surface of spherical magnetite (1,000 parts) having an average particle diameter of 50 micrometers, to produce a carrier.

<Production of Developer>

Developers were produced by mixing each toner (5 parts) and the carrier (95 parts) with a ball mill.

<Evaluation of Toner Properties>

With each toner or each developer, various properties were evaluated in the manners described below. The results are presented in Table 3.

<<Low-Temperature Fixability>>

After the developers were filled in the units of IMAGIO MP C4300 (available from Ricoh Co., Ltd.), a rectangular solid image having a size of 2 cm×15 cm was formed on a PPC sheet TYPE 6000<70W>, A4, long grain (available from Ricoh Co., Ltd.) in a manner that the amount of the toner to be attached would be 0.40 mg/cm$^2$.

Here, the surface temperature of the fixing roller was changed in order to observe whether there would occur an offset of any residual developed image of the solid image being fixed at any other position than the desired position, to evaluate low-temperature fixability according to the criteria described below.

[Evaluation Criteria for Low-Temperature Fixability]

A: Lower than 110 degrees C.

B: 110 degrees C. or higher but lower than 120 degrees C.

C: 120 degrees C. or higher but lower than 130 degrees C.

D: 130 degrees C. or higher

<<Heat-Resistant Storage Stability>>

Each toner was filled in a 50 mL glass container, left to stand in a thermostat bath of 50 degrees C. for 24 hours, and then cooled to 24 degrees C. Subsequently, the penetration [mm] of the toner was measured according to a penetration test (JISK2235-1991), to evaluate heat-resistant storage stability according the criteria described below.

[Evaluation Criteria for Heat-Resistant Storage Stability]

A: The penetration was 20 mm or greater.

B: The penetration was 15 mm or greater but less than 20 mm.

C: The penetration was 10 mm or greater but less than 15 mm.

D: The penetration was less than 10 mm.

<<Image Quality Evaluation>>

After the developers were filled in the units of IMAGIO MP C4300 (available from Ricoh Co., Ltd.), a A4-size solid image was continuously printed on a hundred PPC sheets TYPE 6000<70W>, A4, long grain (available from Ricoh Co., Ltd.), to evaluate whether there would occur any abnormal image due to adhesion of toner lump on the output images according to the criteria described below.

[Evaluation Criteria for Image Quality]

A: There was no adhesion of toner lump.

B: There were 1 or more but less than 5 adhesions of toner lump.

C: There were 5 or more but less than 30 adhesions of toner lump.

D: There were 30 or more adhesions of toner lump.

TABLE 3

| | Maximum length [nm] | Dv/Dn [—] | SF1 [—] | A/C | Low-temperature fixability | Heat-resistant storage stability | Image quality evaluation (stress resistance) |
|---|---|---|---|---|---|---|---|
| Ex. 1 | 211 | 1.19 | 115 | 95/5 | B | A | A |
| Ex. 2 | 310 | 1.09 | 119 | 95/5 | A | A | A |
| Ex. 3 | 117 | 1.07 | 129 | 95/5 | A | B | B |
| Ex. 4 | 496 | 1.15 | 109 | 95/5 | B | A | A |
| Ex. 5 | 485 | 1.11 | 135 | 95/5 | B | B | B |
| Ex. 6 | 308 | 1.12 | 118 | 85/15 | A | A | A |
| Ex. 7 | 304 | 1.12 | 116 | 70/30 | A | B | B |
| Ex. 8 | 308 | 1.12 | 117 | 65/35 | B | B | B |
| Comp. Ex. 1 | 435 | 1.24 | 127 | 95/5 | D | B | C |
| Comp. Ex. 2 | 525 | 1.14 | 126 | 95/5 | D | B | D |
| Comp. Ex. 3 | 745 | 1.25 | 896 | 95/5 | D | D | D |
| Comp. Ex. 4 | 80 | 1.14 | 124 | 95/5 | A | D | C |
| Comp. Ex. 5 | 600 | 4.21 | 762 | 95/5 | C | D | D |

As proved by Examples described above, the present disclosure can provide a toner having a better low-temperature fixability and a better heat-resistant storage stability, and further having an excellent stress resistance and an excellent image quality.

The embodiments of the present disclosure are, for example, as follows:

<1> A toner including at least:

a non-crystalline polyester resin; and a crystalline polyester resin, wherein when a cross-section of the toner is observed, the crystalline polyester resin has a maximum length of 100 nm or greater but less than 500 nm, and a ratio Dv/Dn of a volume average diameter Dv of the crystalline polyester resin to a number average diameter Dn of the crystalline polyester resin is less than 1.20.

<2> The toner according to <1>, wherein when the cross-section of the toner is observed, the crystalline polyester resin has a shape factor SF1 of 100 or greater but less than 130.

<3> The toner according to <1> or <2>, wherein a content ratio X (=A/C) of a content (A) of the non-crystalline polyester resin to a content (C) of the crystalline polyester resin in the toner is from 95/5 through 70/30.

<4> The toner according to any one of <1> to <3>, wherein the non-crystalline polyester resin includes a polyester resin containing a urethane bond and a urea bond.

<5> A toner stored unit including the toner according to any one of <1> to <4>, wherein the toner is stored in the toner stored unit.

<6> An image forming apparatus including:

an electrostatic latent image bearer;

an electrostatic latent image forming unit configured to form an electrostatic latent image on the electrostatic latent image bearer;

a developing unit including a toner and configured to develop the electrostatic latent image formed on the electrostatic latent image bearer with the toner to form a toner image;

a transfer unit configured to transfer the toner image formed on the electrostatic latent image bearer onto a surface of a recording medium; and a fixing unit configured to fix the toner image transferred onto the surface of the recording medium, wherein the toner is the toner according to any one of <1> to <4>.

<7> A method for producing a toner, wherein the toner includes at least a non-crystalline polyester resin and a crystalline polyester resin, the method including:

(a) a step of dissolving at least the crystalline polyester resin in an organic solvent to obtain a solution;

(b) a step of allowing the solution to undergo phase-transfer emulsification, and subsequently removing the organic solvent from the solution to obtain a dispersion liquid of the crystalline polyester resin in water;

(c) a step of mixing in an aqueous medium, an oil phase obtained by dissolving or dispersing a toner material including at least the non-crystalline polyester resin in an organic solvent, and the dispersion liquid of the crystalline polyester resin in water, and emulsifying or dispersing a liquid in which the toner material and the crystalline polyester resin are mixed or dispersed, to obtain an emulsified or dispersed liquid; and (d) a step of removing the organic solvent from the emulsified or dispersed liquid.

<8> The method for producing a toner according to <7>, wherein the step of emulsifying or dispersing the liquid in which the toner material and the crystalline polyester resin are mixed or dispersed, to obtain the emulsified or dispersed liquid includes:

(c1) a step of mixing the oil phase obtained by dissolving or dispersing the toner material including at least the non-crystalline polyester resin in the organic solvent, with the dispersion liquid of the crystalline polyester resin in water, to obtain a mixture liquid; and (c2) a step of emulsifying or dispersing the mixture liquid in the aqueous medium, to obtain the emulsified or dispersed liquid.

The toner according to any one of <1> to <4>, the toner stored unit according to <5>, the image forming apparatus according to <6>, and the method for producing a toner according to <7> or <8> can solve the various problems in the related art and can achieve the object of the present disclosure.

What is claimed is:

1. A toner, comprising:

a non-crystalline polyester resin;

a crystalline polyester resin; and a styrene acrylic/polyester hybrid resin, wherein when a cross-section of the toner is observed, the crystalline polyester resin has a maximum length of 100 nm or greater but less than 500 nm, and a ratio Dv/Dn of a volume average diameter Dv of the crystalline polyester resin to a number average diameter Dn of the crystalline polyester resin is less than 1.20.

2. The toner according to claim 1, wherein when the cross-section of the toner is observed, the crystalline polyester resin has a shape factor SF1 of 100 or greater but less than 130.

3. The toner according to claim 1, wherein the non-crystalline polyester resin comprises a polyester resin that comprises a urethane bond and a urea bond.

4. The toner according to claim 1, wherein the ratio Dv/Dn is 1.15 or less.

5. The toner according to claim 1, further comprising:

an ester wax.

6. A toner stored unit comprising the toner according to claim 1, wherein the toner is stored in the toner stored unit.

7. An image forming apparatus comprising:

an electrostatic latent image bearer;

an electrostatic latent image forming unit configured to form an electrostatic latent image on the electrostatic latent image bearer;

a developing unit that comprises a toner and is configured to develop the electrostatic latent image formed on the electrostatic latent image bearer with the toner to form a toner image;

a transfer unit configured to transfer the toner image formed on the electrostatic latent image bearer onto a surface of a recording medium; and a fixing unit configured to fix the toner image transferred onto the surface of the recording medium, wherein the toner comprises the toner according to claim 1.

8. A method for producing the toner according to claim 1, the method comprising:

(a) dissolving at least the crystalline polyester resin in an organic solvent to obtain a solution;

(b) allowing the solution to undergo phase-transfer emulsification, and subsequently removing the organic solvent from the solution, to obtain a dispersion liquid of the crystalline polyester resin in water;

(c) mixing in an aqueous medium, an oil phase obtained by dissolving or dispersing a toner material that comprises the non-crystalline polyester resin and the styrene acrylic/polyester hybrid resin in an organic solvent, and the dispersion liquid of the crystalline polyester resin in water, and emulsifying or dispersing a liquid in which the toner material and the crystalline polyester resin are mixed or dispersed, to obtain an emulsified or dispersed liquid; and (d) removing the organic solvent from the emulsified or dispersed liquid.

9. The method for producing a toner according to claim 8, wherein the emulsifying or dispersing the liquid in which the toner material and the crystalline polyester resin are mixed or dispersed, to obtain the emulsified or dispersed liquid comprises:

(c1) mixing the oil phase obtained by dissolving or dispersing the toner material that comprises the non-crystalline polyester resin and the styrene acrylic/polyester hybrid resin in the organic solvent, with the dispersion liquid of the crystalline polyester resin in water, to obtain a mixture liquid; and (c2) emulsifying or dispersing the mixture liquid in the aqueous medium, to obtain the emulsified or dispersed liquid.

* * * * *